US009542955B2

(12) United States Patent
Atti et al.

(10) Patent No.: US 9,542,955 B2
(45) Date of Patent: Jan. 10, 2017

(54) HIGH-BAND SIGNAL CODING USING MULTIPLE SUB-BANDS

(71) Applicant: QUALCOMM Incorporated, San Diego, CA (US)

(72) Inventors: Venkatraman S. Atti, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/672,868

(22) Filed: Mar. 30, 2015

(65) Prior Publication Data

US 2015/0279384 A1 Oct. 1, 2015

Related U.S. Application Data

(60) Provisional application No. 61/973,135, filed on Mar. 31, 2014.

(51) Int. Cl.

| | |
|---|---|
| ***G10L 19/12*** | (2013.01) |
| ***G10L 19/00*** | (2013.01) |
| ***G10L 19/24*** | (2013.01) |
| ***G10L 19/08*** | (2013.01) |
| *G10L 21/038* | (2013.01) |

(52) U.S. Cl.

CPC ..... *G10L 19/24* (2013.01); *G10L 19/08* (2013.01); *G10L 21/038* (2013.01)

(58) Field of Classification Search

None

See application file for complete search history.

(56) References Cited

U.S. PATENT DOCUMENTS

| | | | | |
|---|---|---|---|---|
| 7,136,810 | B2 * | 11/2006 | Paksoy | G10L 21/038 704/219 |
| 7,330,814 | B2 * | 2/2008 | McCree | G10L 21/038 704/219 |
| 8,041,562 | B2 * | 10/2011 | Thyssen | G10L 19/005 704/212 |
| 8,082,156 | B2 * | 12/2011 | Shimada | G10L 19/0208 704/500 |

(Continued)

OTHER PUBLICATIONS

International Search Report and Written Opinion of the International Searching Authority (EPO) for International Application No. PCT/US2015/023490, mailed Jun. 30, 2015, 11 pages.

*Primary Examiner* — Satwant Singh

(74) *Attorney, Agent, or Firm* — Toler Law Group, PC

(57) ABSTRACT

A method includes receiving, at a vocoder, an audio signal sampled at a first sample rate. The method also includes generating, at a low-band encoder of the vocoder, a low-band excitation signal based on a low-band portion of the audio signal. The method further includes generating a first baseband signal at a high-band encoder of the vocoder. Generating the first baseband signal includes performing a spectral flip operation on a nonlinearly transformed version of the low-band excitation signal. The first baseband signal corresponds to a first sub-band of a high-band portion of the audio signal. The method also includes generating a second baseband signal corresponding to a second sub-band of the high-band portion of the audio signal. The first sub-band is distinct from the second sub-band.

44 Claims, 16 Drawing Sheets

(56) References Cited

U.S. PATENT DOCUMENTS

| | | | | |
|---|---|---|---|---|
| 8,280,728 | B2 * | 10/2012 | Chen | G10L 19/005 704/219 |
| 8,457,952 | B2 * | 6/2013 | Chen | G10L 19/005 704/219 |
| 8,751,225 | B2 * | 6/2014 | Lee | G10L 19/0208 704/224 |
| 8,788,276 | B2 * | 7/2014 | Neuendorf | G10L 21/038 704/500 |
| 8,831,933 | B2 * | 9/2014 | Duni | G10L 19/038 704/222 |
| 8,924,222 | B2 * | 12/2014 | Rajendran | G10L 19/038 704/207 |
| 9,117,440 | B2 * | 8/2015 | Mundt | G10L 19/008 |
| 9,208,792 | B2 * | 12/2015 | Rajendran | G10L 19/028 |
| 9,412,383 | B1 * | 8/2016 | Truman | G10L 21/038 |
| 9,412,388 | B1 * | 8/2016 | Truman | G10L 21/038 |
| 9,412,389 | B1 * | 8/2016 | Truman | G10L 21/038 |
| 2011/0295598 | A1 * | 12/2011 | Yang | G10L 21/038 704/205 |
| 2014/0088973 | A1 * | 3/2014 | Gibbs | G10L 19/20 704/500 |
| 2015/0003632 | A1 * | 1/2015 | Thesing | G10L 19/0204 381/98 |
| 2015/0279379 | A1 * | 10/2015 | Truman | G10L 21/038 704/500 |
| 2015/0380006 | A1 * | 12/2015 | Atti | G10L 19/032 704/205 |
| 2015/0380007 | A1 * | 12/2015 | Atti | G10L 19/032 704/219 |
| 2015/0380008 | A1 * | 12/2015 | Atti | G10L 19/265 704/500 |

* cited by examiner

HIGH-BAND SIGNAL CODING USING MULTIPLE SUB-BANDS

I. CLAIM OF PRIORITY

The present application claims priority from U.S. Provisional Application No. 61/973,135, filed Mar. 31, 2014, which is entitled "HIGH-BAND SIGNAL CODING USING MULTIPLE SUB-BANDS," the content of which is incorporated by reference in its entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

Transmission of voice by digital techniques is widespread, particularly in long distance and digital radio telephone applications. There may be an interest in determining the least amount of information that can be sent over a channel while maintaining a perceived quality of reconstructed speech. If speech is transmitted by sampling and digitizing, a data rate on the order of sixty-four kilobits per second (kbps) may be used to achieve a speech quality of an analog telephone. Through the use of speech analysis, followed by coding, transmission, and re-synthesis at a receiver, a significant reduction in the data rate may be achieved.

Devices for compressing speech may find use in many fields of telecommunications. An exemplary field is wireless communications. The field of wireless communications has many applications including, e.g., cordless telephones, paging, wireless local loops, wireless telephony such as cellular and personal communication service (PCS) telephone systems, mobile IP telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems.

The IS-95 standard subsequently evolved into "3G" systems, such as cdma2000 and WCDMA, which provide more capacity and high speed packet data services. Two variations of cdma2000 are presented by the documents IS-2000 (cdma2000 1×RTT) and IS-856 (cdma2000 1×EV-DO), which are issued by TIA. The cdma2000 1×RTT communication system offers a peak data rate of 153 kbps whereas the cdma2000 1×EV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214. The International Mobile Telecommunications Advanced (IMT-Advanced) specification sets out "4G" standards. The IMT-Advanced specification sets peak data rate for 4G service at 100 megabits per second (Mbit/s) for high mobility communication (e.g., from trains and cars) and 1 gigabit per second (Gbit/s) for low mobility communication (e.g., from pedestrians and stationary users).

Devices that employ techniques to compress speech by extracting parameters that relate to a model of human speech generation are called speech coders. Speech coders may comprise an encoder and a decoder. The encoder divides the incoming speech signal into blocks of time, or analysis frames. The duration of each segment in time (or "frame") may be selected to be short enough that the spectral envelope of the signal may be expected to remain relatively stationary. For example, one frame length is twenty milliseconds, which corresponds to 160 samples at a sampling rate of eight kilohertz (kHz), although any frame length or sampling rate deemed suitable for the particular application may be used.

The encoder analyzes the incoming speech frame to extract certain relevant parameters, and then quantizes the parameters into binary representation, e.g., to a set of bits or a binary data packet. The data packets are transmitted over a communication channel (i.e., a wired and/or wireless network connection) to a receiver and a decoder. The decoder processes the data packets, unquantizes the processed data packets to produce the parameters, and resynthesizes the speech frames using the unquantized parameters.

The function of the speech coder is to compress the digitized speech signal into a low-bit-rate signal by removing natural redundancies inherent in speech. The digital compression may be achieved by representing an input speech frame with a set of parameters and employing quantization to represent the parameters with a set of bits. If the input speech frame has a number of bits $N_i$, and a data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal.

Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (e.g., 5 millisecond (ms) sub-frames) at a time. For each sub-frame, a high-precision representative from a codebook space is found by means of a search algorithm. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

One time-domain speech coder is the Code Excited Linear Predictive (CELP) coder. In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_o$, for each frame) or at a variable rate (in which different bit rates are used for different types of frame contents). Variable-rate coders attempt to use the amount of bits needed to encode the codec parameters to a level adequate to obtain a target quality.

Time-domain coders such as the CELP coder may rely upon a high number of bits, $N_0$, per frame to preserve the accuracy of the time-domain speech waveform. Such coders may deliver excellent voice quality provided that the number of bits, $N_o$, per frame is relatively large (e.g., 8 kbps or above). At low bit rates (e.g., 4 kbps and below), time-domain coders may fail to retain high quality and robust performance due to the limited number of available bits. At low bit rates, the limited codebook space clips the waveform-matching capability of time-domain coders, which are deployed in higher-rate commercial applications. Hence, despite improvements over time, many CELP coding systems operating at low bit rates suffer from perceptually significant distortion characterized as noise.

An alternative to CELP coders at low bit rates is the "Noise Excited Linear Predictive" (NELP) coder, which operates under similar principles as a CELP coder. NELP coders use a filtered pseudo-random noise signal to model speech, rather than a codebook. Since NELP uses a simpler model for coded speech, NELP achieves a lower bit rate than CELP. NELP may be used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal.

There may be research interest and commercial interest in improving audio quality of a speech signal (e.g., a coded speech signal, a reconstructed speech signal, or both). For example, a communication device may receive a speech signal with lower than optimal voice quality. To illustrate, the communication device may receive the speech signal from another communication device during a voice call. The voice call quality may suffer due to various reasons, such as environmental noise (e.g., wind, street noise), limitations of the interfaces of the communication devices, signal processing by the communication devices, packet loss, bandwidth limitations, bit-rate limitations, etc.

In traditional telephone systems (e.g., public switched telephone networks (PSTNs)), signal bandwidth is limited to the frequency range of 300 Hertz (Hz) to 3.4 kHz. In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 0 Hz to 6.4 kHz, also called the "low-band"). For example, the low-band may be represented using filter parameters and/or a low-band excitation signal. However, in order to improve coding efficiency, the higher frequency portion of the signal (e.g., 6.4 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc.

Predicting the high-band using signal modeling may include generating a high-band excitation signal based on data (e.g., a low-band excitation signal) associated with the low-band. However, generating the high-band excitation signal may include pole-zero filtering operations and down-mixing operations, which may be complex and computationally expensive. Additionally, the high-band excitation signal may be limited to a bandwidth of 8 kHz, and thus may not accurately predict the 9.6 kHz bandwidth of the high-band (e.g., 6.4 kHz to 16 kHz).

IV. SUMMARY

Systems and methods for generating multiple-band harmonically extended signals for improved high-band prediction are disclosed. A speech encoder (e.g., a "vocoder") may generate two or more high-band excitation signals at baseband to model two or more sub-portions of a high-band portion of an input audio signal. For example, the high-band portion of an input audio signal may span from approximately 6.4 kHz to approximately 16 kHz. A speech encoder may generate a first baseband signal representing a first high-band excitation signal by nonlinearly extending a low-band excitation of the input audio signal and may also generate a second baseband signal representing a second high-band excitation signal by nonlinearly extending the low-band excitation of the input audio signal. The first baseband signal may span from 0 Hz to 6.4 kHz to represent a first sub-band of the high-band portion of the input audio signal (e.g., from approximately 6.4 kHz to 12.8 kHz), and the second baseband signal may span from 0 Hz to 3.2 kHz to represent a second sub-band of the high-band portion of the input audio signal (e.g., from approximately 12.8 kHz to 16 kHz). The first baseband signal and the second baseband signal, collectively, may represent excitation signals for the entire high-band portion of the input audio signal (e.g., from 6.4 kHz to 16 kHz).

In a particular aspect, a method includes receiving, at a vocoder, an audio signal sampled at a first sample rate. The method also includes generating a first baseband signal corresponding to a first sub-band of a high-band portion of the audio signal and generating a second baseband signal corresponding to a second sub-band of the high-band portion of the audio signal. The first sub-band may be distinct from the second sub-band. Pole-zero filter operations and down-mixing operations may be bypassed during coding of the first sub-band and the second sub-band.

In another particular aspect, an apparatus includes a vocoder configured to receive an audio signal sampled at a first sample rate. The vocoder is also configured to generate a first baseband signal corresponding to a first sub-band of a high-band portion of the audio signal and to generate a second baseband signal corresponding to a second sub-band of the high-band portion of the audio signal. The first sub-band may be distinct from the second sub-band.

In another particular aspect, a non-transitory computer-readable medium includes instructions that, when executed by a processor within a vocoder, cause the processor to receive an audio signal sampled at a first sample rate. The instructions are also executable to cause the processor to generate a first baseband signal corresponding to a first sub-band of a high-band portion of the audio signal and to generate a second baseband signal corresponding to a second sub-band of the high-band portion of the audio signal. The first sub-band may be distinct from the second sub-band.

In another particular aspect, an apparatus includes means for receiving an audio signal sampled at a first sample rate. The apparatus also includes means for generating a first baseband signal corresponding to a first sub-band of a high-band portion of the audio signal and for generating a second baseband signal corresponding to a second sub-band of the high-band portion of the audio signal. The first sub-band may be distinct from the second sub-band.

In another particular aspect, a method includes receiving, at a vocoder, an audio signal sampled at a first sample rate. The method also includes generating, at a low-band encoder of the vocoder, a low-band excitation signal based on a low-band portion of the audio signal. The method further includes generating a first baseband signal (e.g., a first high-band excitation signal) at a high-band encoder of the vocoder. Generating the first baseband signal includes performing a spectral flip operation on a nonlinearly transformed (e.g., using an absolute (|.|) or a square $(.)^2$ function) version of the low-band excitation signal. Performing such nonlinear transformation on an upsampled low-band excitation signal may harmonically extend the low frequencies (e.g., up to 6.4 kHz) to higher bands (e.g., 6.4 kHz and above). The first baseband signal corresponds to a first sub-band of a high-band portion of the audio signal. The method also includes generating a second baseband signal (e.g., a second high-band excitation signal) corresponding to a second sub-band of the high-band portion of the audio signal. The first sub-band is distinct from the second sub-band.

In another particular aspect, an apparatus includes a low-band encoder of a vocoder and a high-band encoder of a vocoder. The low-band encoder is configured to receive an audio signal sampled at a first sample rate. The low-band encoder is also configured to generate a low-band excitation signal based on a low-band portion of the audio signal. The high-band encoder is configured to generate a first baseband signal (e.g., a first high-band excitation signal). Generating the first baseband signal includes performing a spectral flip operation on a nonlinearly transformed version of the low-band excitation signal. The first baseband signal corresponds to a first sub-band of a high-band portion of the audio signal. The high-band encoder is also configured to generate a second baseband signal (e.g., a second high-band excitation signal) corresponding to a second sub-band of the high-band portion of the audio signal. The first sub-band is distinct from the second sub-band.

In another particular aspect, a non-transitory computer-readable medium includes instructions that, when executed by a processor within a vocoder, cause the processor to perform operations. The operations include receiving an audio signal sampled at a first sample rate. The operations also include generating, at a low-band encoder of the vocoder, a low-band excitation signal based on a low-band portion of the audio signal. The operations further include generating a first baseband signal (e.g., a first high-band excitation signal) at a high-band encoder of the vocoder. Generating the first baseband signal includes performing a spectral flip operation on a nonlinearly transformed version of the low-band excitation signal. The first baseband signal corresponds to a first sub-band of a high-band portion of the audio signal. The operations also include generating a second baseband signal (e.g., a second high-band excitation signal) corresponding to a second sub-band of the high-band portion of the audio signal. The first sub-band is distinct from the second sub-band.

In another particular aspect, an apparatus includes means for receiving an audio signal sampled at a first sample rate. The apparatus also includes means for generating a low-band excitation signal based on a low-band portion of the audio signal. The apparatus further includes means for generating a first baseband signal (e.g., a first high-band excitation signal). Generating the first baseband signal includes performing at a high-band encoder of the vocoder a spectral flip operation on a nonlinearly transformed version of the low-band excitation signal. The first baseband signal corresponds to a first sub-band of a high-band portion of the audio signal. The apparatus also includes means for generating a second baseband signal (e.g., a second high-band excitation signal) corresponding to a second sub-band of the high-band portion of the audio signal. The first sub-band is distinct from the second sub-band.

In another particular aspect, a method includes receiving, at a vocoder, an audio signal having a low-band portion and a high-band portion. The method also includes generating, at a low-band encoder of the vocoder, a low-band excitation signal based on the low-band portion of the audio signal. The method further includes generating, at a high-band encoder of the vocoder, a first baseband signal (e.g., a first high-band excitation signal) based on up-sampling the low-band excitation signal. The method also includes generating a second baseband signal (e.g., a second high-band excitation signal) based on the first baseband signal. The first baseband signal corresponds to a first sub-band of the high-band portion of the audio signal, and the second baseband signal corresponds to a second sub-band of the high-band portion of the audio signal.

In another particular aspect, an apparatus includes a vocoder having a low-band encoder and a high-band encoder. The low-band encoder is configured to generate a low-band excitation signal based on a low-band portion of an audio signal. The audio signal also includes a high-band portion. The high-band encoder is configured to generate a first baseband signal (e.g., a first high-band excitation signal) based on up-sampling the low-band excitation signal. The high-band encoder is further configured to generate a second baseband signal (e.g., a second high-band excitation signal) based on the first baseband signal. The first baseband signal corresponds to a first sub-band of the high-band portion of the audio signal, and the second baseband signal corresponds to a second sub-band of the high-band portion of the audio signal.

In another particular aspect, a non-transitory computer-readable medium includes instructions that, when executed by a processor within a vocoder, cause the processor to perform operations. The operations include receiving an audio signal having a low-band portion and a high-band portion. The operations also include generating a low-band excitation signal based on the low-band portion of the audio signal. The operations further include generating, at a high-band encoder of the vocoder, a first baseband signal (e.g., a first high-band excitation signal) based on up-sampling the low-band excitation signal. The operations also include generating a second baseband signal (e.g., a second high-band excitation signal) based on the first baseband signal. The first baseband signal corresponds to a first sub-band of the high-band portion of the audio signal, and the second baseband signal corresponds to a second sub-band of the high-band portion of the audio signal.

In another particular aspect, an apparatus includes means for receiving an audio signal having a low-band portion and a high-band portion. The apparatus also includes means for generating a low-band excitation signal based on the low-band portion of the audio signal. The apparatus further includes means for generating a first baseband signal (e.g., a first high-band excitation signal) based on up-sampling the low-band excitation signal. The apparatus also includes means for generating a second baseband signal (e.g., a second high-band excitation signal) based on the first baseband signal. The first baseband signal corresponds to a first sub-band of the high-band portion of the audio signal, and the second baseband signal corresponds to a second sub-band of the high-band portion of the audio signal.

In another particular aspect, a method includes receiving, at a decoder, an encoded audio signal from an encoder. The encoded audio signal may include a low-band excitation signal. The method also includes reconstructing a first sub-band of a high-band portion of an audio signal from the encoded audio signal based on the low-band excitation signal. The method further includes reconstructing a second sub-band of the high-band portion of the audio signal from the encoded audio signal based on the low-band excitation signal. For example, the second sub-band may be reconstructed based on up-sampling the low-band excitation signal according to a first up-sampling ratio and further based on up-sampling the low-band excitation signal according to a second up-sampling ratio.

In another particular aspect, an apparatus include a decoder configured to receive an encoded audio signal from an encoder. The encoded audio signal may include a low-band excitation signal. The decoder is also configured to reconstruct a first sub-band of a high-band portion of an audio signal from the encoded audio signal based on the low-band excitation signal. The decoder is further configured to reconstruct a second sub-band of the high-band portion of the audio signal from the encoded audio signal based on the low-band excitation signal.

In another particular aspect, a non-transitory computer-readable medium includes instructions that, when executed by a processor within a decoder, cause the processor to receive an encoded audio signal from an encoder. The encoded audio signal may include a low-band excitation signal. The instructions are also executable to cause the processor to reconstruct a first sub-band of a high-band portion of an audio signal from the encoded audio signal based on the low-band excitation signal. The instructions are further executable to cause the processor to reconstruct a second sub-band of the high-band portion of the audio signal from the encoded audio signal based on the low-band excitation signal.

In another particular aspect, an apparatus includes means for receiving an encoded audio signal from an encoder. The encoded audio signal may include a low-band excitation signal. The apparatus also includes means for reconstructing a first sub-band of a high-band portion of an audio signal from the encoded audio signal based on the low-band excitation signal. The apparatus further includes means for reconstructing a second sub-band of the high-band portion of the audio signal from the encoded audio signal based on the low-band excitation signal.

Particular advantages provided by at least one of the disclosed aspects include reducing complex and computationally expensive operations associated with pole-zero filtering and the down-mixing during generation of high-band excitation signals and synthesized high-band signals. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

Figure 1:
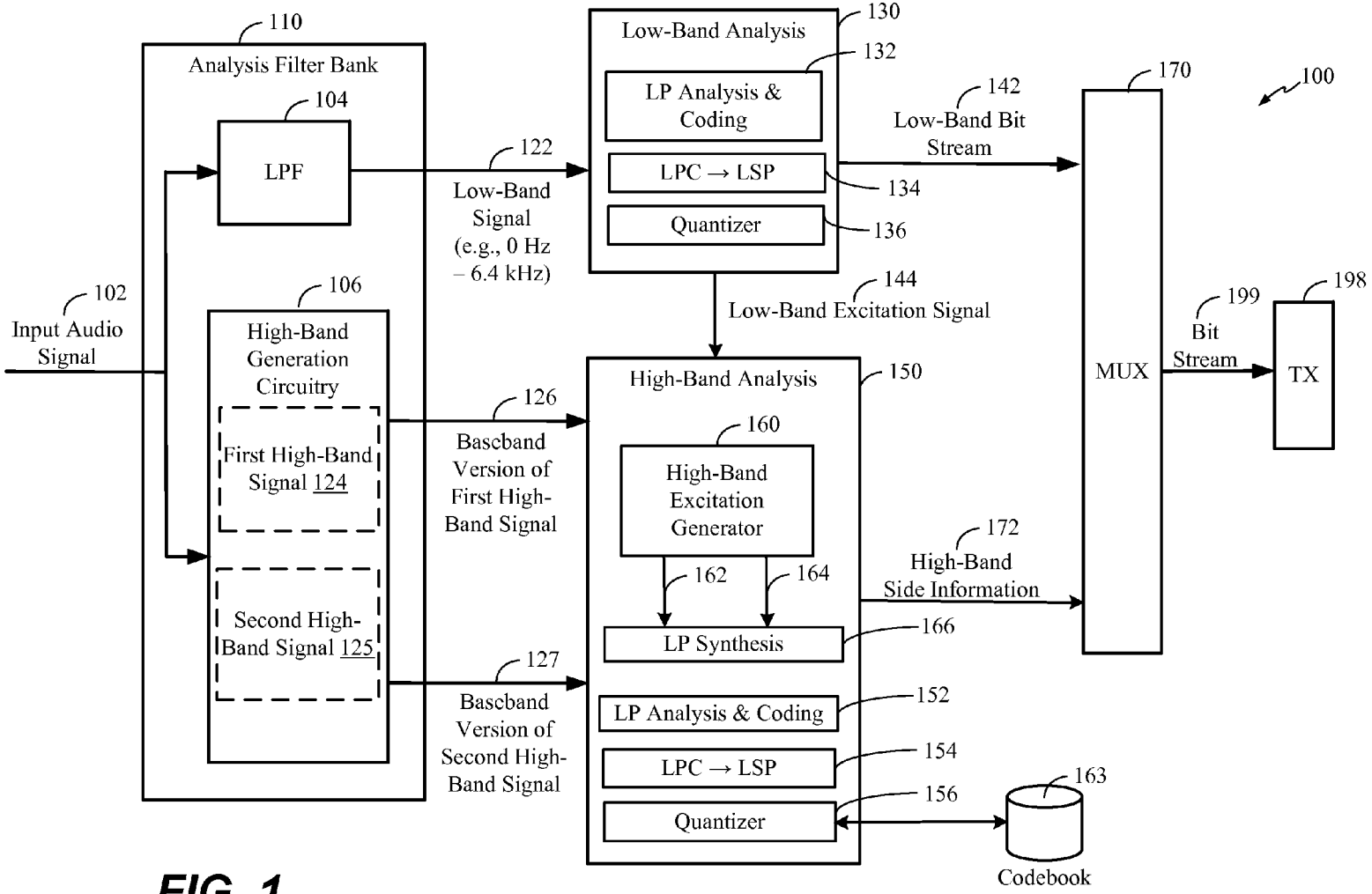
FIG. 1 is a diagram to illustrate a particular aspect of a system that is operable to generate multiple-band harmonically extended signals.
Figure 3:
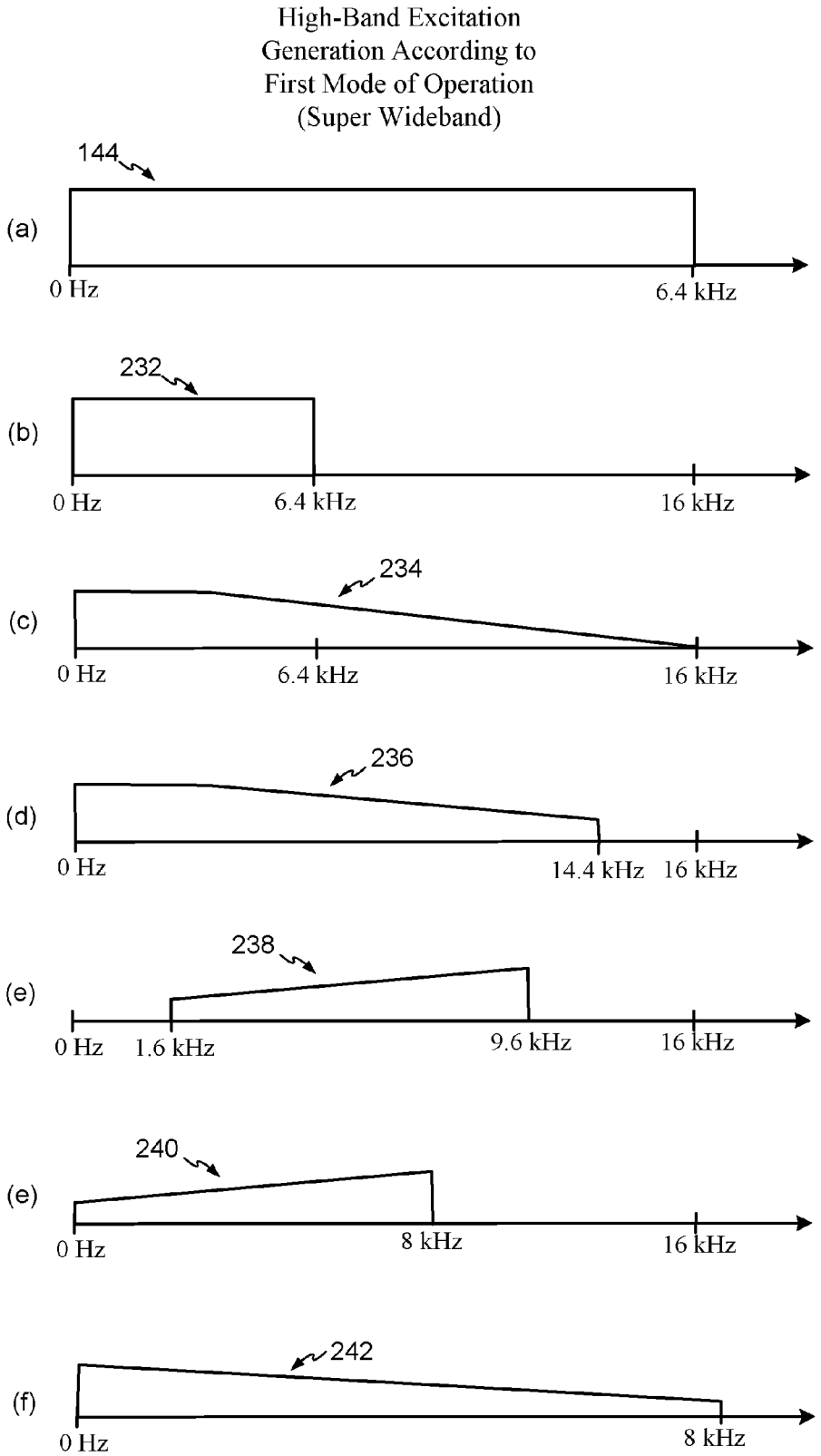
Figure 4A:
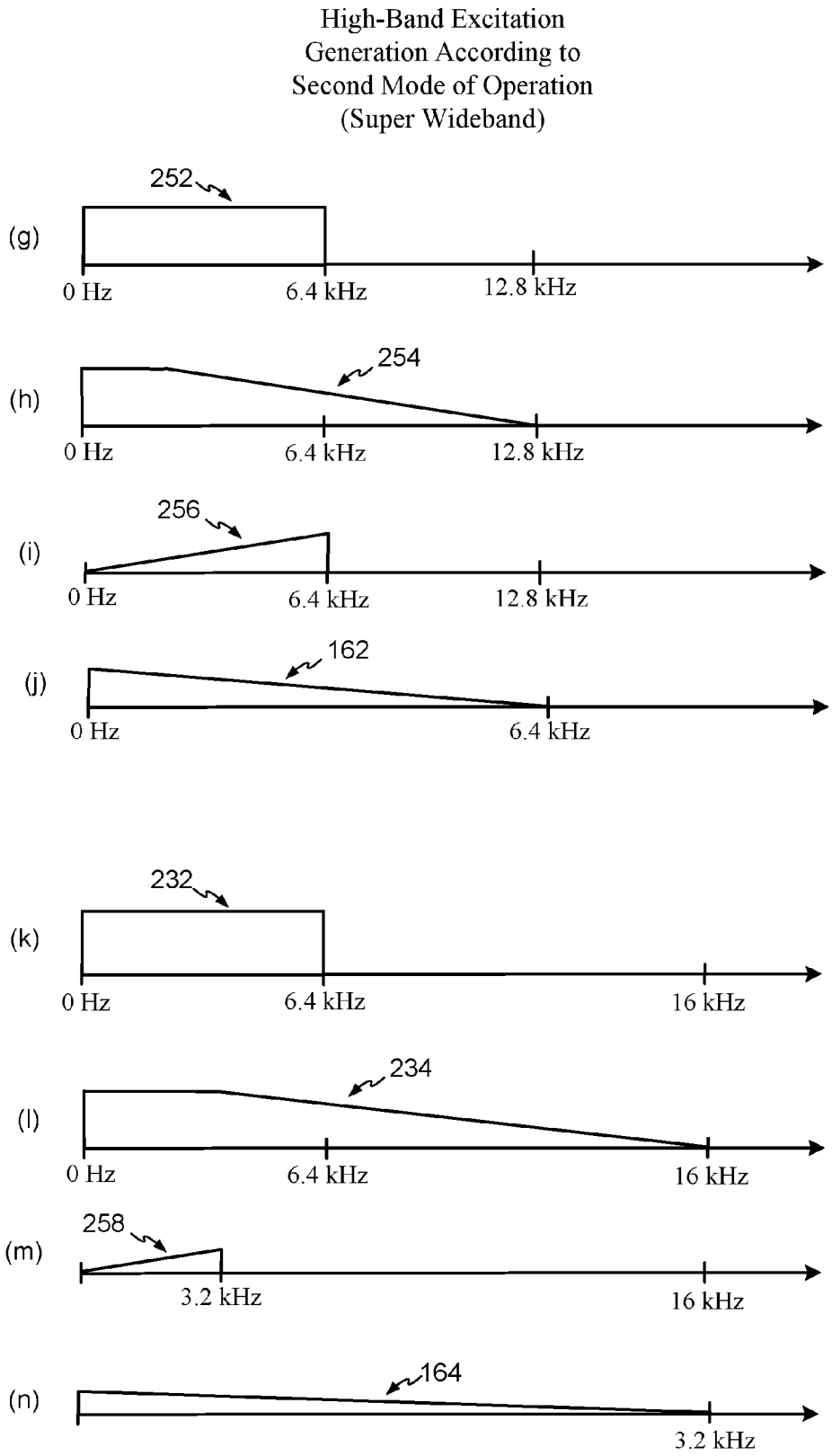
Figure 4B:
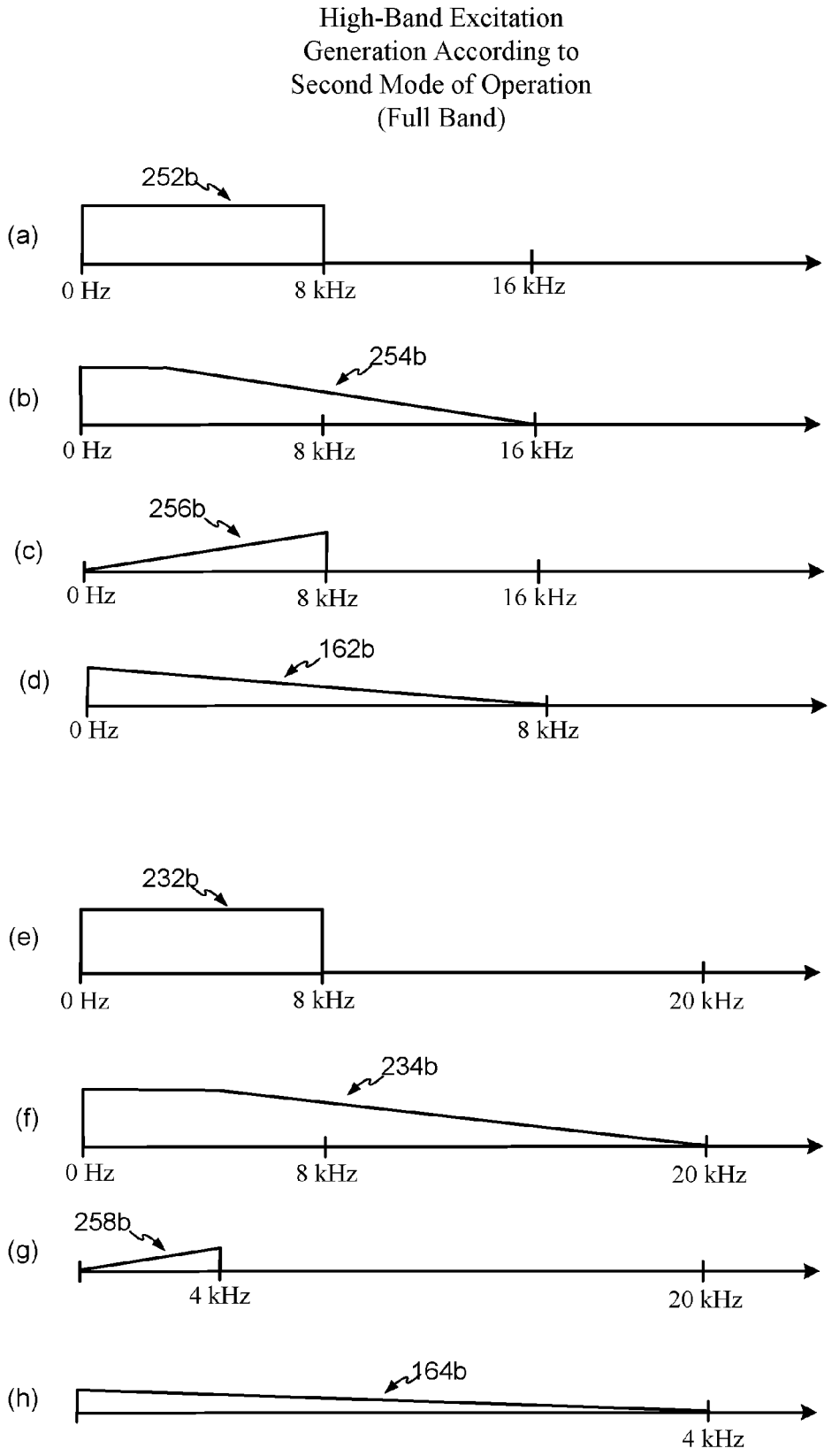
Figure 5:
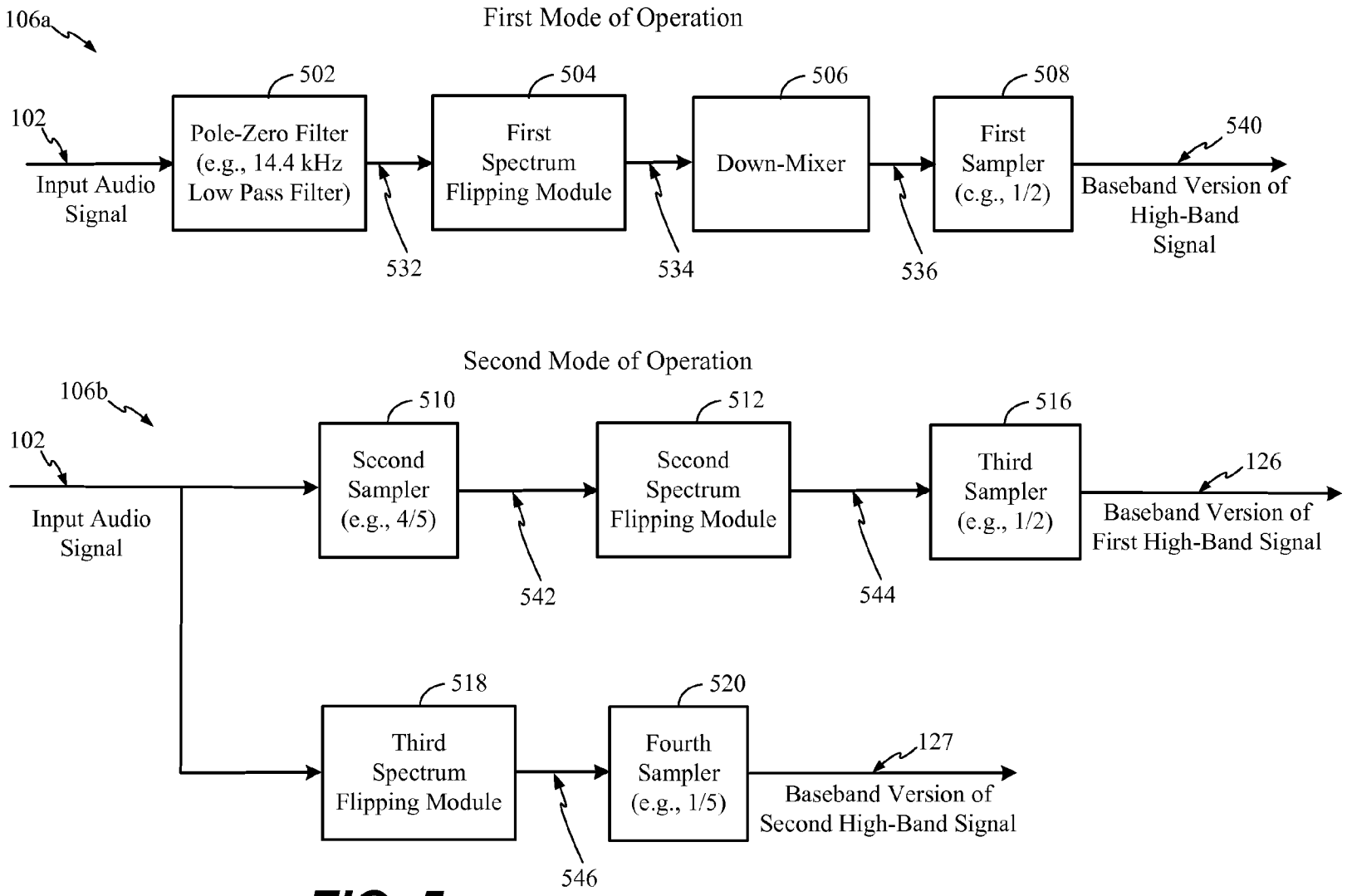
Figure 6:
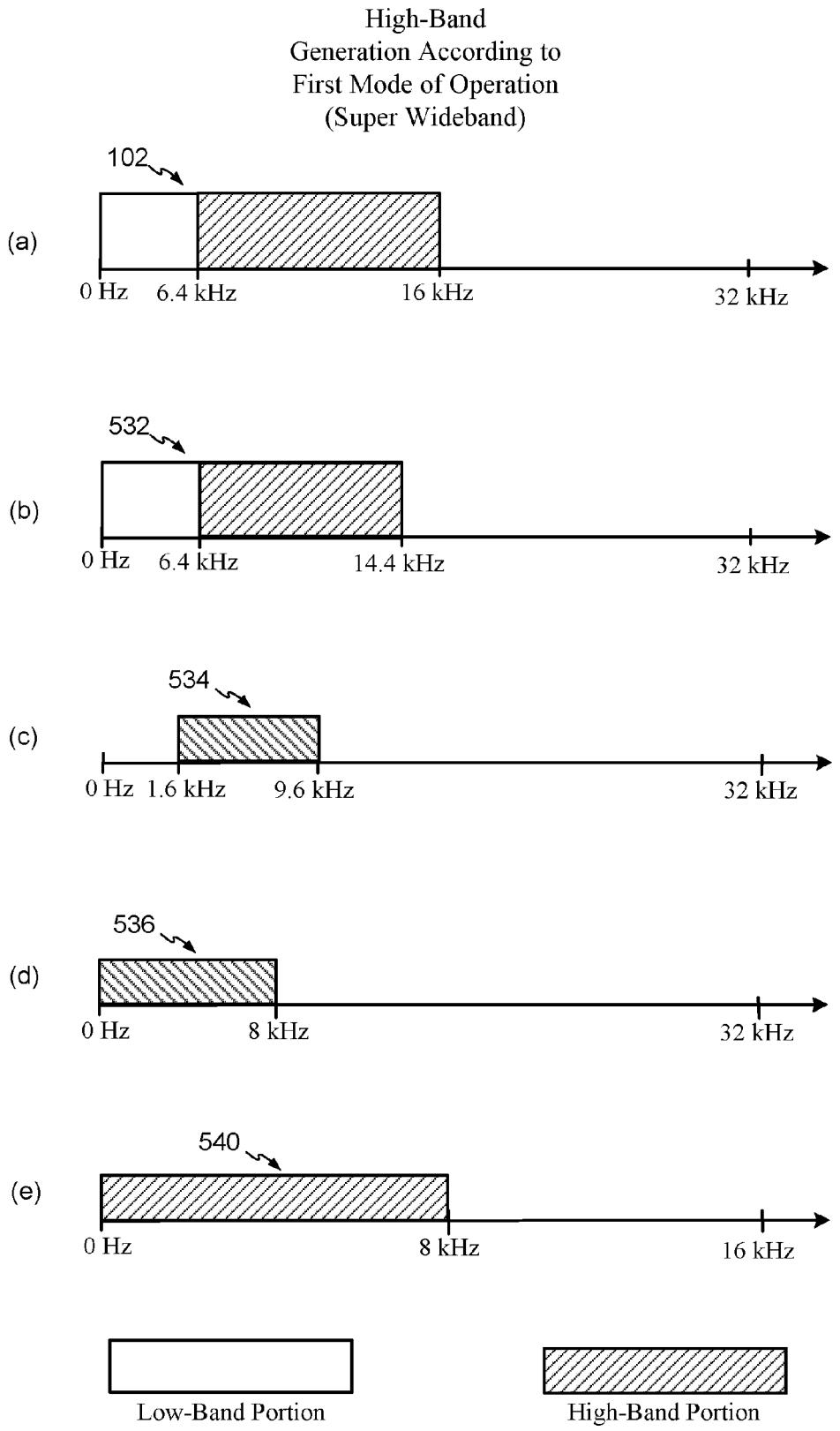
Figure 7A:
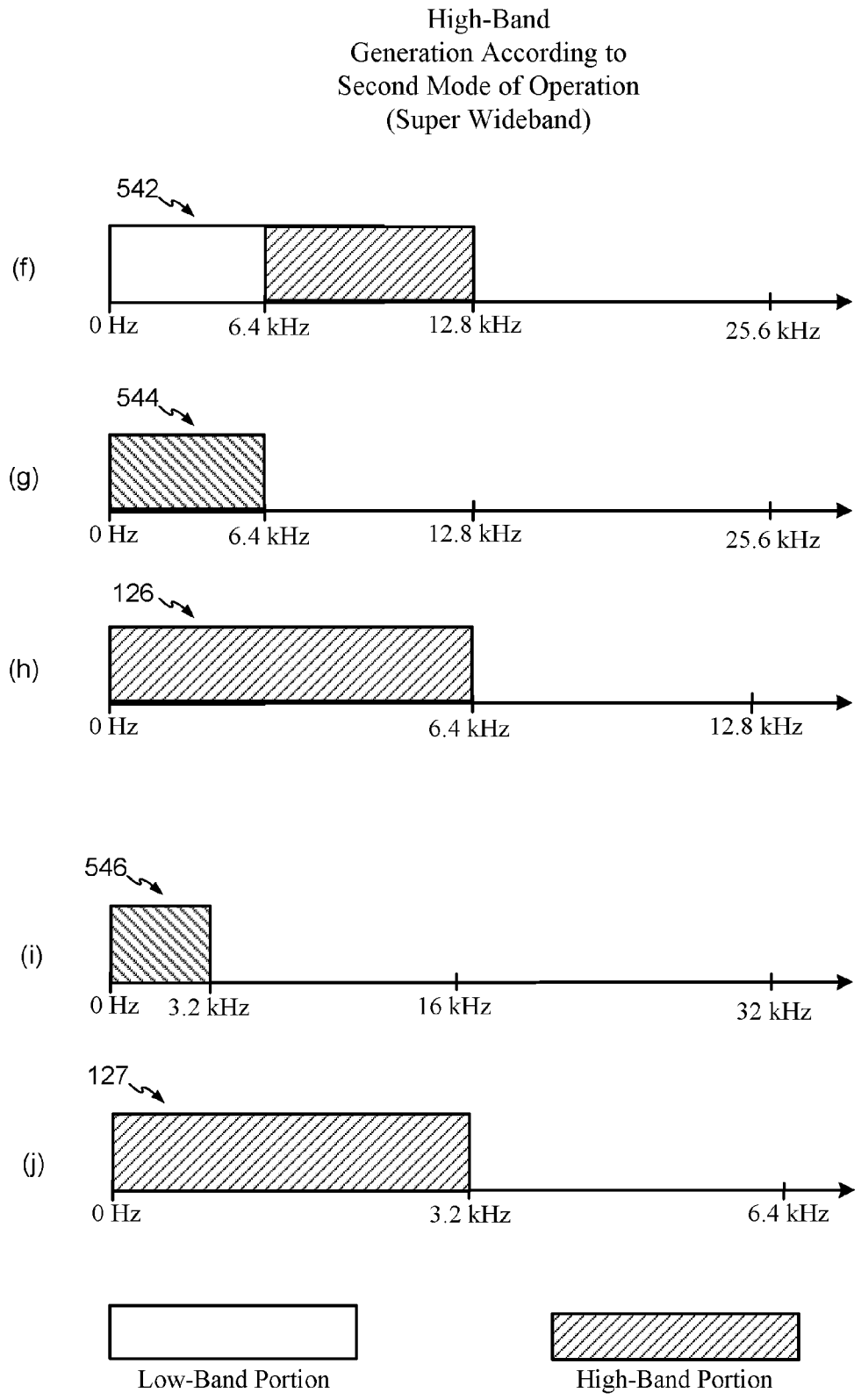
Figure 7B:
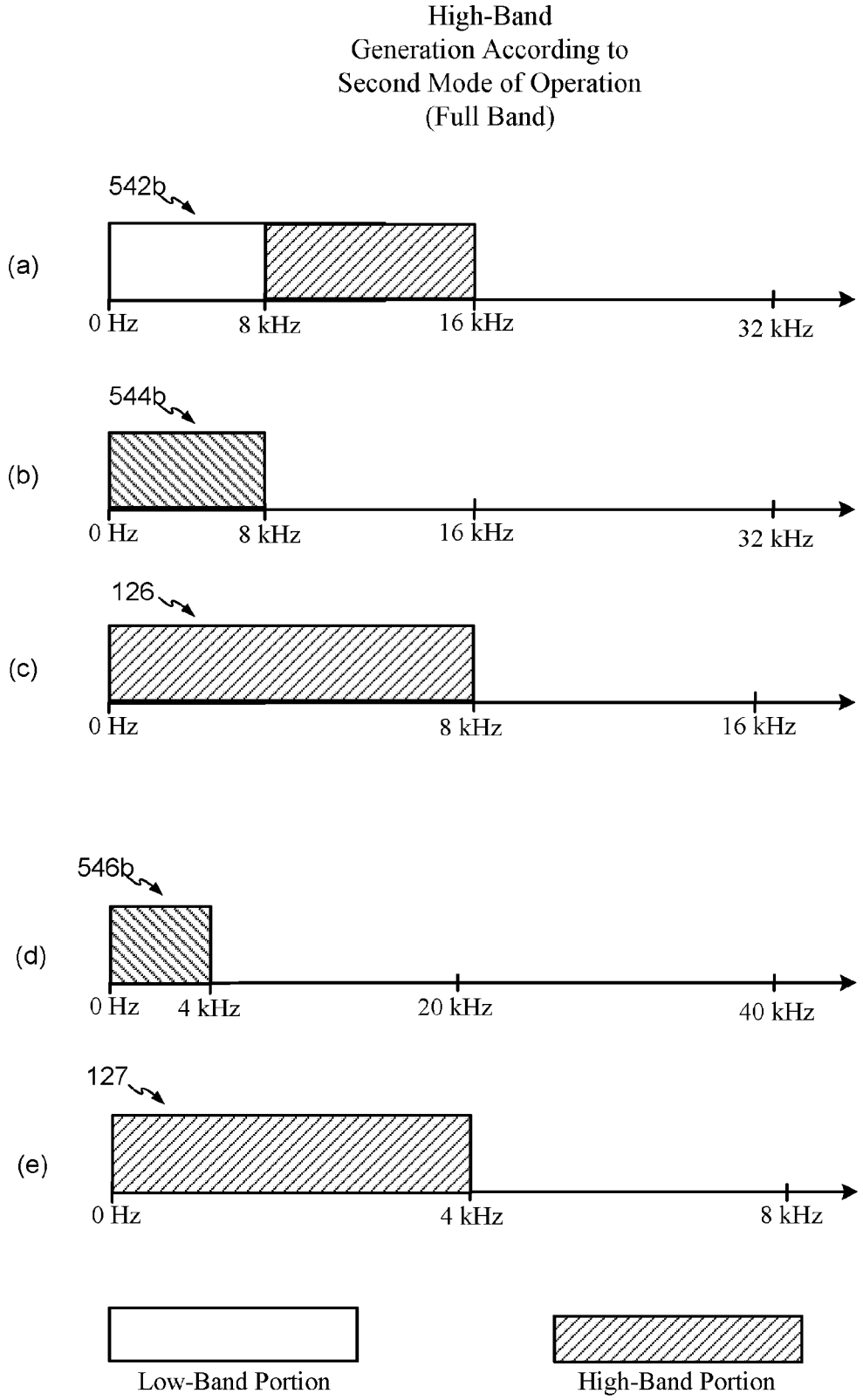
Figure 8:
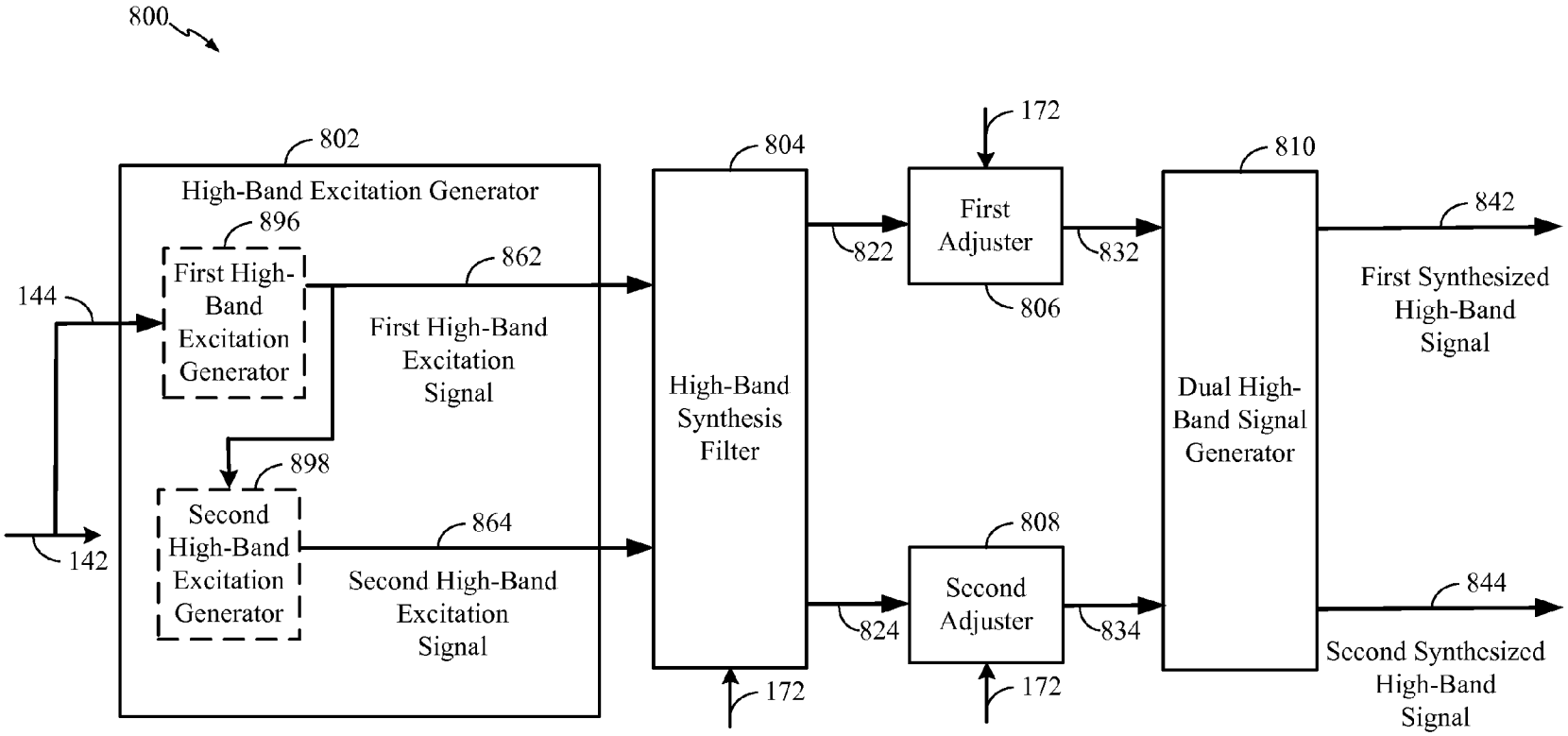
Figure 9:
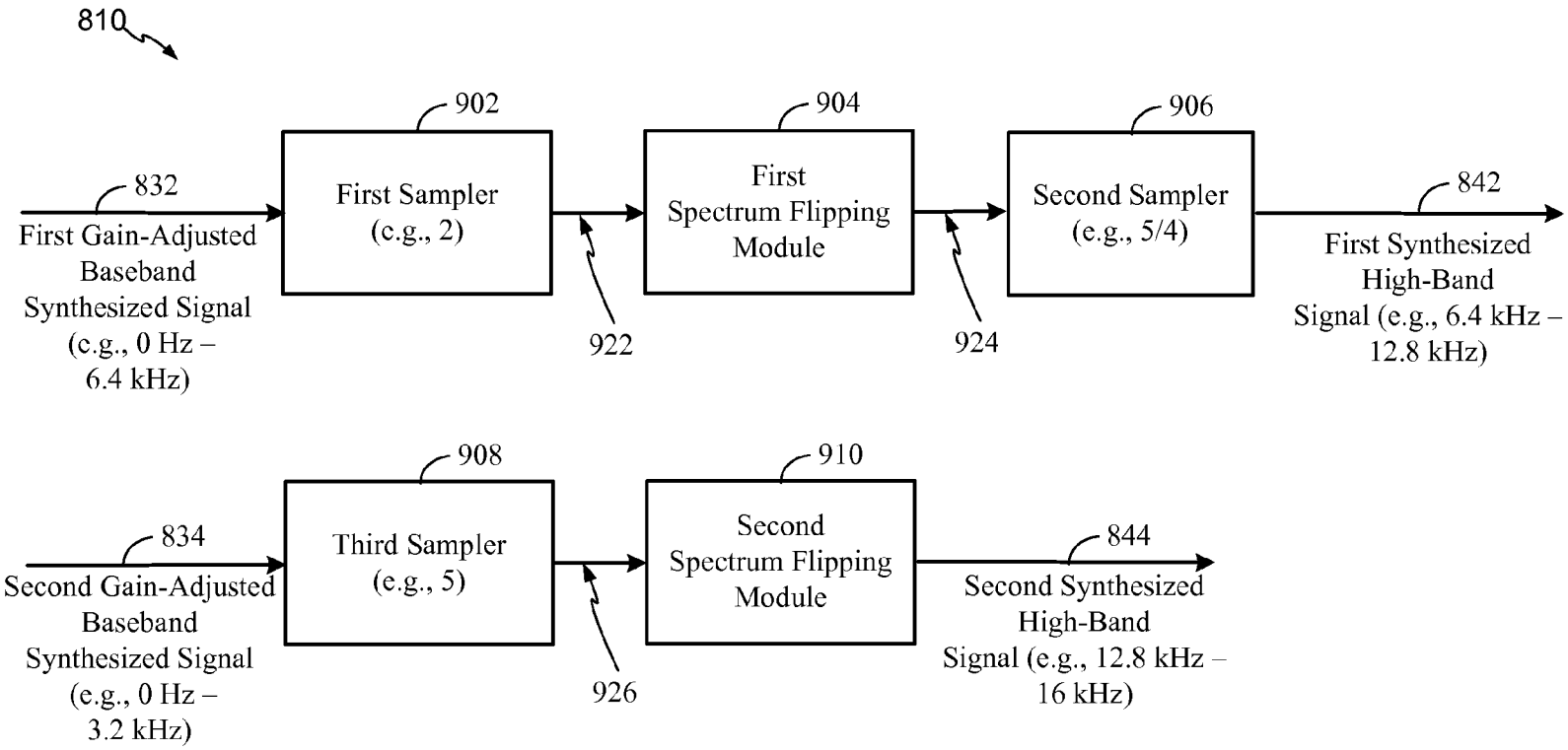
Figure 10:
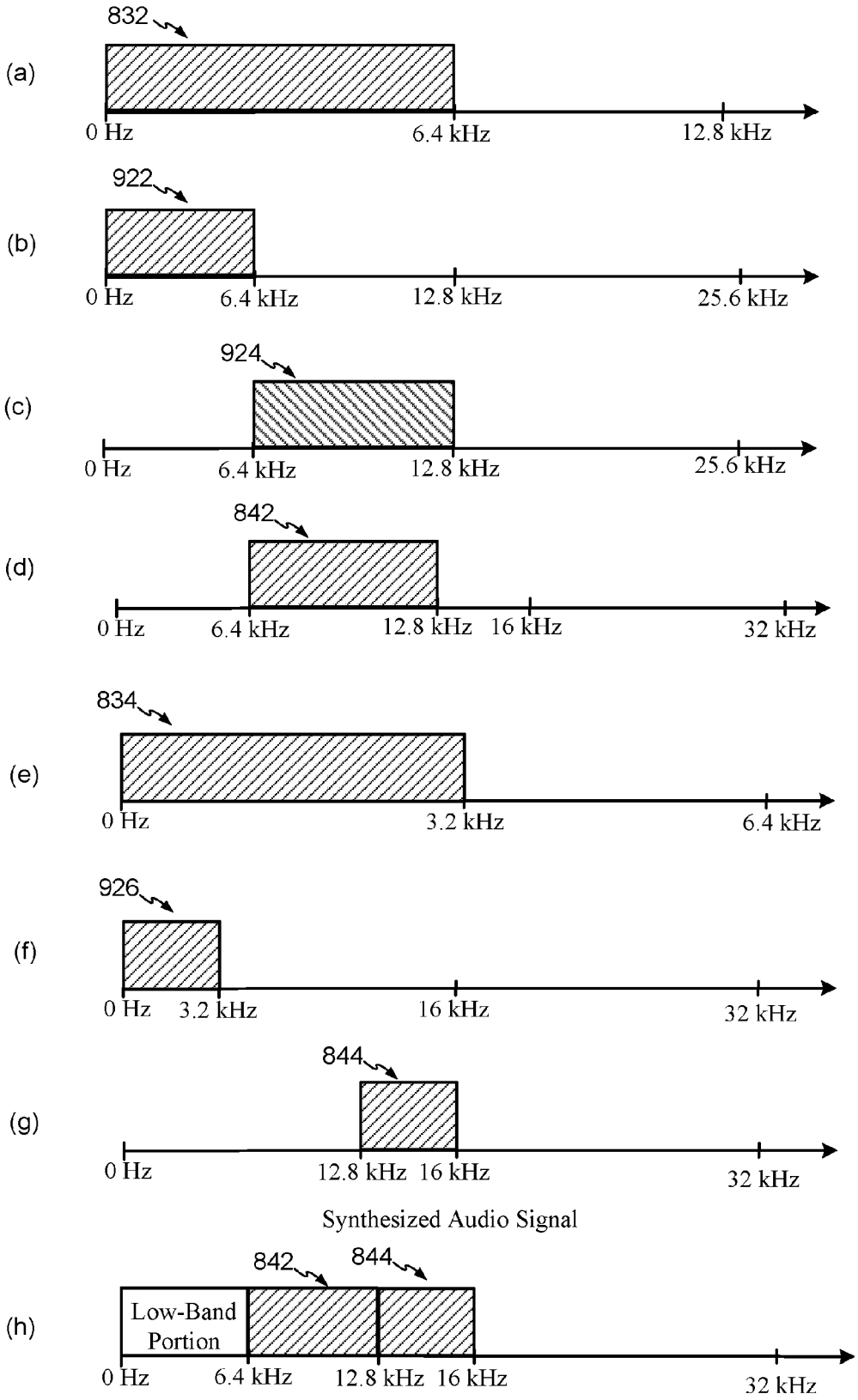
Figure 11:
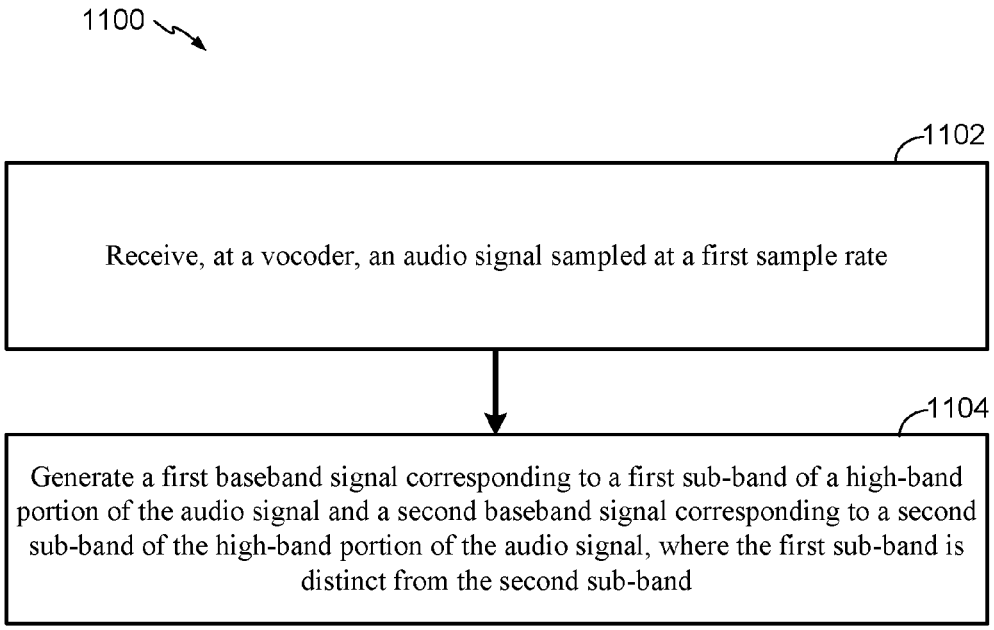
Figure 12:
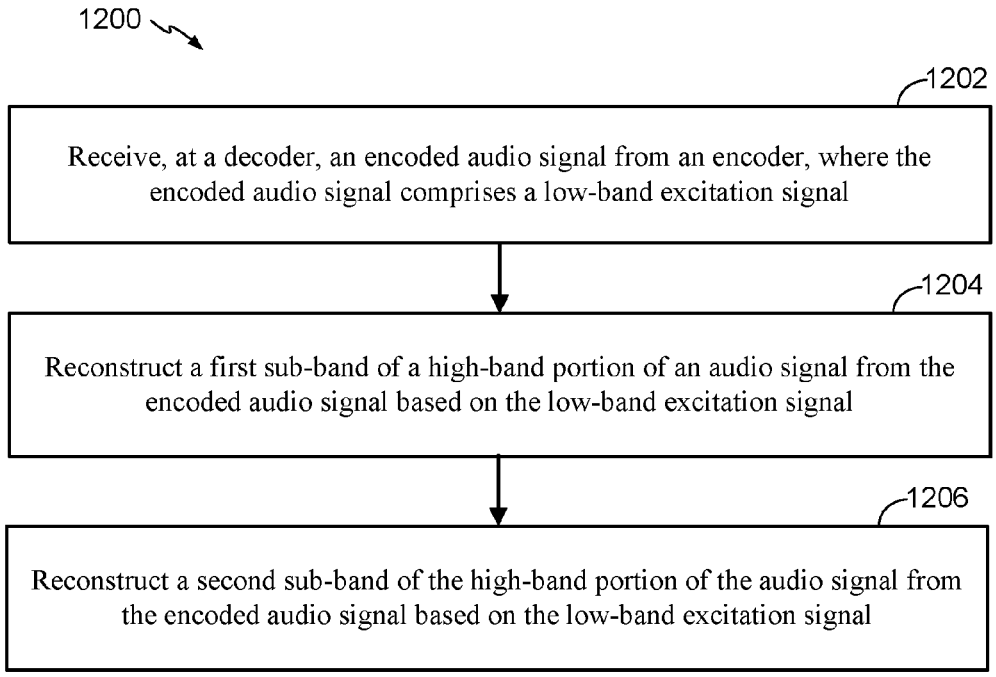
Figure 13:
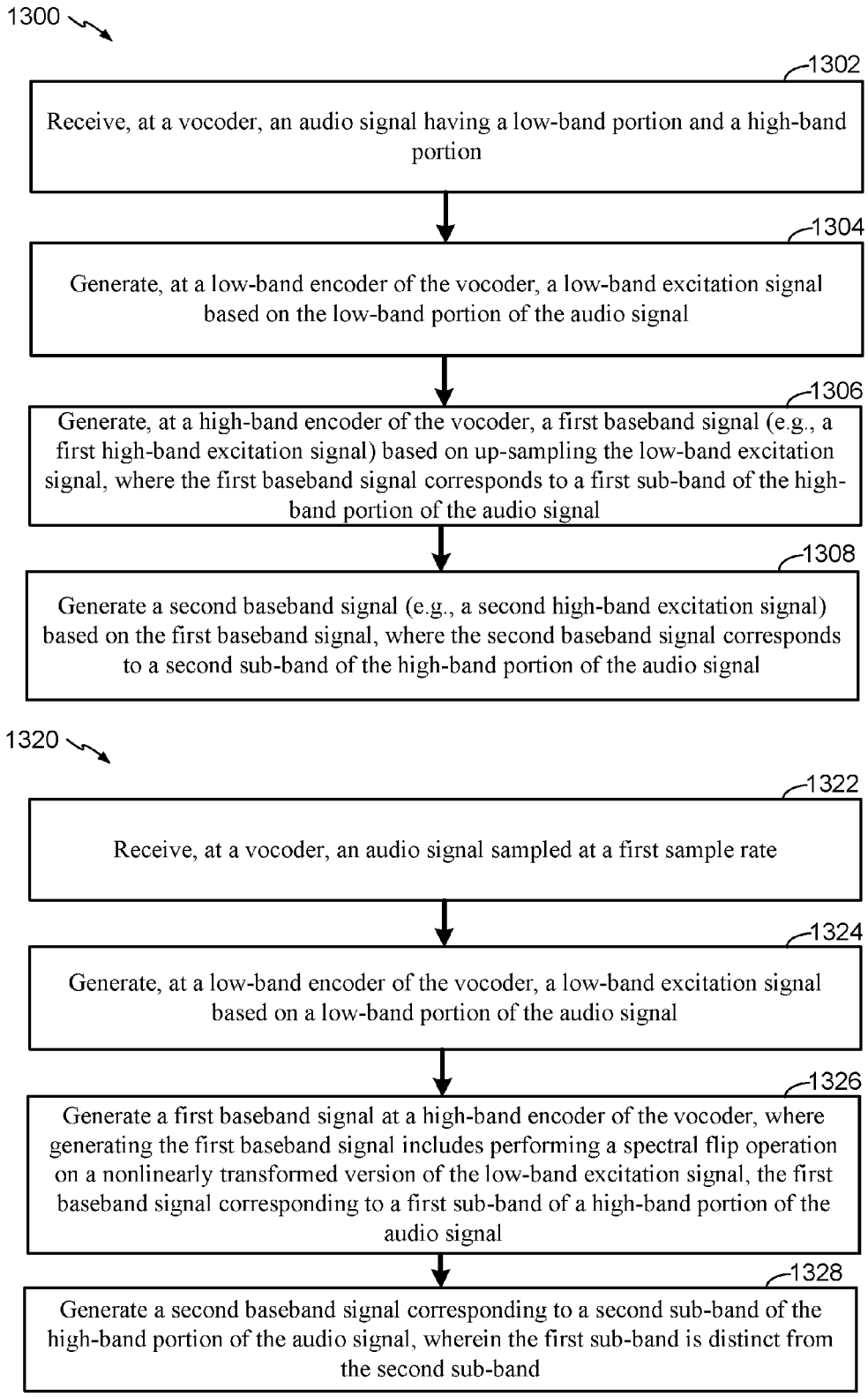
Figure 14:
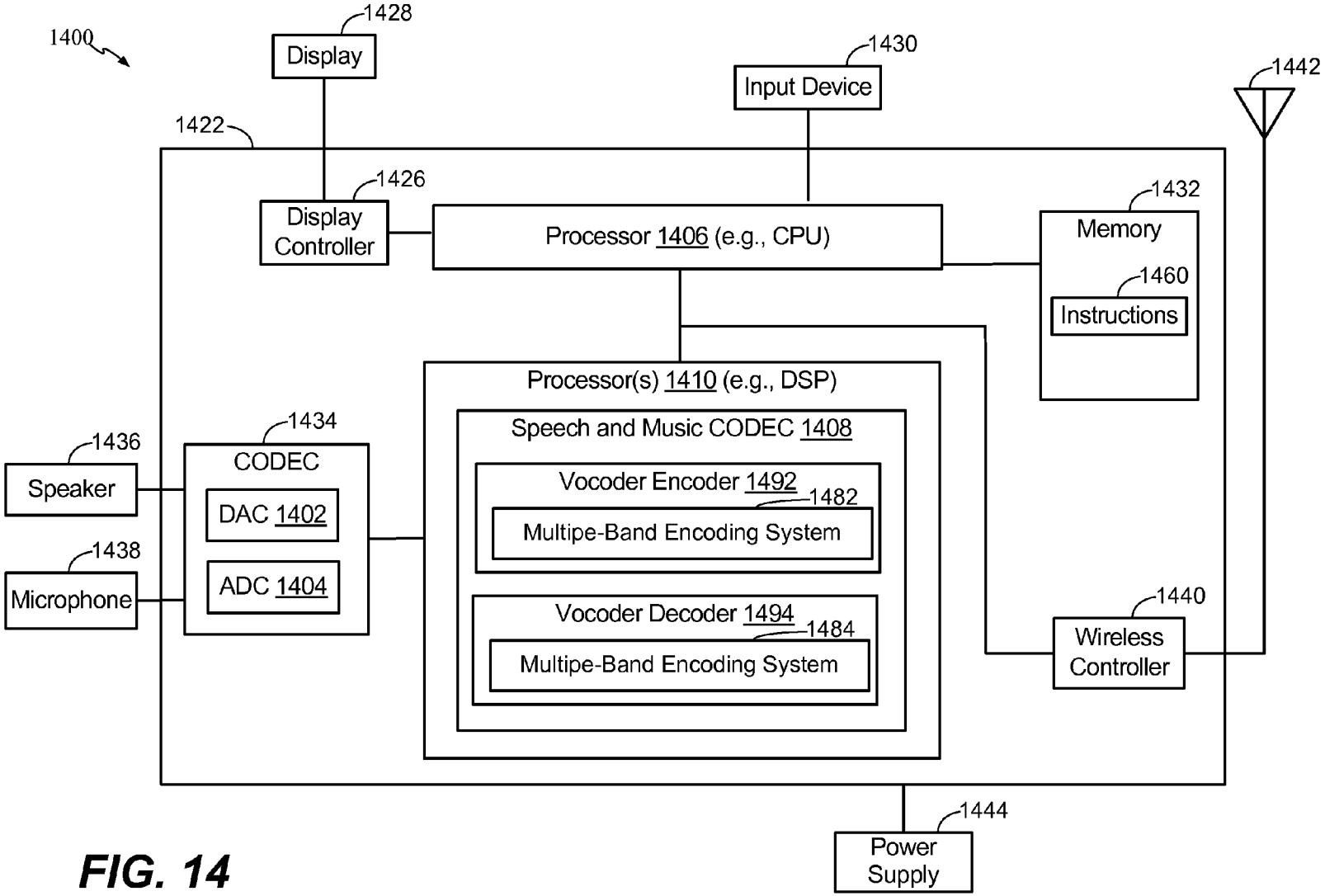

FIG. 3 includes diagrams illustrating super wideband generation of a single-band harmonically extended signal according to a first mode;

FIG. 4A includes diagrams illustrating super wideband generation of multiple-band harmonically extended signals according to a second mode;

FIG. 4B includes diagrams illustrating full band generation of multiple-band harmonically extended signals according to the second mode;

FIG. 5 is a diagram to illustrate particular aspects of high-band generation circuitry of FIG. 1;

FIG. 6 includes diagrams illustrating generation of a single-band baseband version of a high-band portion of an input audio signal according to a first mode;

FIG. 7A includes diagrams illustrating super wideband generation of a multiple-band baseband version of a high-band portion of an input audio signal according to a second mode;

FIG. 7B includes diagrams illustrating full band generation of a multiple-band baseband version of a high-band portion of an input audio signal according to a second mode;

FIG. 8 is a diagram to illustrate a particular aspect of a system that is operable to reconstruct multiple sub-bands of a high-band portion of an input audio signal;

FIG. 9 is a diagram to illustrate a particular aspect of the dual high-band synthesis circuitry of FIG. 8 configured to generate multiple sub-bands of the high-band portion of the input audio signal;

FIG. 10 includes diagrams illustrating generation of multiple sub-bands of the high-band portion of the input audio signal;

FIG. 11 depicts a flowchart to illustrate a particular aspect of a method of generating baseband signals;

FIG. 12 depicts a flowchart to illustrate a particular aspect of a method of reconstructing multiple sub-bands of a high-band portion of an input audio signal;

FIG. 13 depicts flowcharts to illustrate other particular aspect of methods of generating baseband signals; and FIG. 14 is a block diagram of a wireless device operable to perform signal processing operations in accordance with the systems, diagrams, and methods of FIGS. 1-13.

VI. DETAILED DESCRIPTION

Referring to FIG. 1, a particular aspect of a system that is operable to generate multiple-band harmonically extended signals is shown and generally designated 100. In a particular aspect, the system 100 may be integrated into an encoding system or apparatus (e.g., in a coder/decoder (CODEC) of a wireless telephone). In other aspects, the system 100 may be integrated into a set top box, a music player, a video player, an entertainment unit, a navigation device, a communications device, a PDA, a fixed location data unit, or a computer, as illustrative non-limiting examples. In a particular aspect, the system 100 may correspond to, or be included in, a vocoder.

It should be noted that in the following description, various functions performed by the system 100 of FIG. 1 are described as being performed by certain components or modules. However, this division of components and modules is for illustration only. In an alternate aspect, a function performed by a particular component or module may instead be divided amongst multiple components or modules. Moreover, in an alternate aspect, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes an analysis filter bank 110 that is configured to receive an input audio signal 102. For example, the input audio signal 102 may be provided by a microphone or other input device. In a particular aspect, the input audio signal 102 may include speech. The input audio signal 102 may include speech content in the frequency range from approximately 0 Hz to approximately 16 kHz. As used herein, "approximately" may include frequencies within a particular range of the described frequency. For example, approximately may include frequencies within ten percent of the described frequency, five percent of the described frequency, one percent of the described frequency, etc. As an illustrative non-limiting example, "approximately 16 kHz" may include frequencies from 15.2 kHz (e.g., 16 kHz−16 kHz*0.05) to 16.8 kHz (e.g., 16 kHz+16 kHz*0.05). The analysis filter bank 110 may filter the input audio signal 102 into multiple portions based on frequency. For example, the analysis filter bank 110 may include a low pass filter (LPF) 104 and high-band generation circuitry 106. The input audio signal 102 may be provided to the low pass filter 104 and to the high-band generation circuitry 106. The low pass filter 104 may be configured to filter out high-frequency components of the input audio signal 102 to generate a low-band signal 122. For example, the low pass filter 104 may have a cut-off frequency of approximately 6.4 kHz to generate the low-band signal 122 having a bandwidth that extends from approximately 0 Hz to approximately 6.4 kHz.

The high-band generation circuitry 106 may be configured to generate baseband versions 126, 127 of high-band signals 124, 125 (e.g., a baseband version 126 of a first high-band signal 124 and a baseband version 127 of a second high-band signal 125) based on the input audio signal 102. For example, the high-band of the input audio signal 102 may correspond to components of the input audio signal 102 occupying the frequency range between approximately 6.4 kHz and approximately 16 kHz. The high-band of the input audio signal 102 may be split into the first high-band signal 124 (e.g., a first sub-band spanning from approximately 6.4 kHz to approximately 12.8 kHz) and the second high-band signal 125 (e.g., a second sub-band spanning from approximately 12.8 kHz to approximately 16 kHz). The baseband version 126 of the first high-band signal 124 may have a 6.4 kHz bandwidth (e.g., 0 Hz-6.4 kHz) and may represent the 6.4 kHz bandwidth of the first high-band signal 124 (e.g., the frequency range from 6.4 kHz-12.8 kHz). In a similar manner, the baseband version 127 of the second high-band signal 125 may have a 3.2 kHz bandwidth (e.g., 0 Hz-3.2 kHz) and may represent the 3.2 kHz bandwidth of the second high-band signal 125 (e.g., the frequency range from 12.8 kHz-16 kHz). It should be noted that the frequency ranges described above are for illustrative purposes only and should not be construed as limiting. In other aspects, the high-band generation circuitry 106 may generate more than two baseband signals. Examples of the operation of the high-band generation circuitry 106 are described in greater detail with respect to FIGS. 5-7B. In another particular aspect, the high-band generation circuitry 106 may be integrated into a high-band analysis module 150.

The above example illustrates filtering for SWB coding (e.g., coding from approximately 0 Hz to 16 kHz). In other examples, the analysis filter bank 110 may filter an input audio signal for full band (FB) coding (e.g., coding from approximately 0 Hz to 20 kHz). To illustrate, the input audio signal 102 may include speech content in the frequency range from approximately 0 Hz to approximately 20 kHz. The low pass filter 104 may have a cut-off frequency of approximately 8 kHz to generate the low-band signal 122 having a bandwidth that extends from approximately 0 Hz to approximately 8 kHz. According to the FB coding, the high-band of the input audio signal 102 may correspond to components of the input audio signal 102 occupying the frequency range between approximately 8 kHz and approximately 20 kHz. The high-band of the input audio signal 102 may be split into the first high-band signal 124 (e.g., a first sub-band spanning from approximately 8 kHz to approximately 16 kHz) and the second high-band signal 125 (e.g., a second sub-band spanning from approximately 16 kHz to approximately 20 kHz). The baseband version 126 of the first high-band signal 124 may have a 8 kHz bandwidth (e.g., 0 Hz-8 kHz) and may represent the 8 kHz bandwidth of the first high-band signal 124 (e.g., the frequency range from 8 kHz-16 kHz). In a similar manner, the baseband version 127 of the second high-band signal 125 may have a 4 kHz bandwidth (e.g., 0 Hz-4 kHz) and may represent the 4 kHz bandwidth of the second high-band signal 125 (e.g., the frequency range from 16 kHz-20 kHz).

For ease of illustration, unless other noted, the following description is generally described with respect to SWB coding. However, similar techniques may be applied to perform FB coding. For example, the bandwidth, and thus the frequency range, of each signal described with respect to FIGS. 1-4A, 5-7A, and 8-13 for SWB coding may be extended by a factor of approximately 1.25 to perform FB coding. As a non-limiting example, a high-band excitation signal (at baseband) described for SWB coding as having a frequency range spanning from 0 Hz to 6.4 kHz for may have a frequency range spanning from 0 Hz to 8 kHz in a FB coding implementation. Non-limiting examples of extending such techniques to FB coding are described with respect to FIGS. 4B and 7B.

The system 100 may include a low-band analysis module 130 configured to receive the low-band signal 122. In a particular aspect, the low-band analysis module 130 may represent a CELP encoder. The low-band analysis module 130 may include an LP analysis and coding module 132, a linear prediction coefficient (LPC) to LSP transform module 134, and a quantizer 136. LSPs may also be referred to as LSFs, and the two terms (LSP and LSF) may be used interchangeably herein. The LP analysis and coding module 132 may encode a spectral envelope of the low-band signal 122 as a set of LPCs. LPCs may be generated for each frame of audio (e.g., 20 ms of audio, corresponding to 320 samples at a sampling rate of 16 kHz), for each sub-frame of audio (e.g., 5 ms of audio), or any combination thereof. The number of LPCs generated for each frame or sub-frame may be determined by the "order" of the LP analysis performed. In a particular aspect, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error of the low-band excitation signal 144.

The system 100 may further include a high-band analysis module 150 configured to receive the baseband versions 126, 127 of the high-band signals 124, 125 from the analysis filter bank 110 and to receive the low-band excitation signal 144 from the low-band analysis module 130. The high-band analysis module 150 may generate high-band side information 172 based on the baseband versions 126, 127 of the high-band signals 124, 125 and based on the low-band excitation signal 144. For example, the high-band side information 172 may include high-band LSPs, gain information, and/or phase information.

As illustrated, the high-band analysis module 150 may include an LP analysis and coding module 152, a LPC to LSP transform module 154, and a quantizer 156. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). The LP analysis and coding module 152 may generate a first set of LPCs for the baseband version 126 of the first high-band signal 124 that are transformed to a first set of LSPs by the transform module 154 and quantized by the quantizer 156 based on a codebook 163. Additionally, the LP analysis and coding module 152 may generate a second set of LPCs for the baseband version 127 of the second high-band signal 125 that are transformed to a second set of LSPs by the transform module 154 and quantized by the quantizer 156 base on the codebook 163. Because the second sub-band (e.g., the second high-band signal 125) corresponds to a frequency spectrum that has reduced perceptual value as compared to the first sub-band (e.g., the first high-band signal 124), the second set of LPCs may be reduced as compared to the first set of LPCs (e.g., using a lower order filter) for encoding efficiency.

The LP analysis and coding module 152, the transform module 154, and the quantizer 156 may use the baseband versions 126, 127 of the high-band signals 124, 125 to determine high-band filter information (e.g., high-band LSPs) that is included in the high-band side information 172. For example, the LP analysis and coding module 152, the transform module 154, and the quantizer 156 may use the baseband version 126 of the first high-band signal 124 and a first high-band excitation signal 162 to determine a first set of the high-band side information 172 for the bandwidth between 6.4 kHz and 12.8 kHz. The first set of the high-band side information 172 may correspond to a phase shift between the baseband version 126 of the first high-band signal 124 and the first high-band excitation signal 162, a gain associated with the baseband version 126 of the first high-band signal 124 and the first high-band excitation signal 162, etc. In addition, the LP analysis and coding module 152, the transform module 154, and the quantizer 156 may use the baseband version 127 of the second high-band signal 125 and a second high-band excitation signal 164 to determine a second set of the high-band side information 172 for the bandwidth between 12.8 kHz and 16 kHz. The second set of the high-band side information 172 may correspond to a phase shift between the baseband version 127 of the second high-band signal 125 and the second high-band excitation signal 164, a gain associated with the baseband version 127 of the second high-band signal 125 and the second high-band excitation signal 164, etc.

The quantizer 156 may be configured to quantize a set of spectral frequency values, such as LSPs provided by the transform module 154. In other aspects, the quantizer 156 may receive and quantize sets of one or more other types of spectral frequency values in addition to, or instead of, LSFs or LSPs. For example, the quantizer 156 may receive and quantize a set of LPCs generated by the LP analysis and coding module 152. Other examples include sets of parcor coefficients, log-area-ratio values, and ISFs that may be received and quantized at the quantizer 156. The quantizer 156 may include a vector quantizer that encodes an input vector (e.g., a set of spectral frequency values in a vector format) as an index to a corresponding entry in a table or codebook, such as the codebook 163. As another example, the quantizer 156 may be configured to determine one or more parameters from which the input vector may be generated dynamically at a decoder, such as in a sparse codebook implementation, rather than retrieved from storage. To illustrate, sparse codebook examples may be applied in coding schemes such as CELP and codecs according to industry standards such as 3GPP2 (Third Generation Partnership 2) EVRC (Enhanced Variable Rate Codec). In another aspect, the high-band analysis module 150 may include the quantizer 156 and may be configured to use a number of codebook vectors to generate synthesized signals (e.g., according to a set of filter parameters) and to select one of the codebook vectors associated with the synthesized signal that best matches the baseband versions 126, 127 of the high-band signals 124, 125, such as in a perceptually weighted domain.

The high-band analysis module 150 may also include a high-band excitation generator 160 (e.g., a multiple-band nonlinear excitation generator). The high-band excitation generator 160 may generate multiple high-band excitation signals 162, 164 (e.g., harmonically extended signals) having different bandwidths based on the low-band excitation signal 144 from the low-band analysis module 130. For example, the high-band excitation generator 160 may generate a first high-band excitation signal 162 occupying a baseband bandwidth of approximately 6.4 kHz (corresponding to the bandwidth of components of the input audio signal 102 occupying the frequency range between approximately 6.4 kHz and 12.8 kHz) and a second high-band excitation signal 164 occupying a baseband bandwidth of approximately 3.2 kHz (corresponding to the bandwidth of components of the input audio signal 102 occupying the frequency range between approximately 12.8 kHz and 16 kHz).

The high-band analysis module 150 may also include an LP synthesis module 166. The LP synthesis module 166 uses the LPC information generated by the quantizer 156 to generate synthesized versions of the baseband versions 126, 127 of the high-band signals 124, 125. The high-band excitation generator 160 and the LP synthesis module 166 may be included in a local decoder that emulates performance at a decoder device at a receiver. An output of the LP synthesis module 166 may be used for comparison to the baseband versions 126, 127 of the high-band signals 124, 125 and parameters (e.g., gain parameters) may be adjusted based on the comparison.

The low-band bit stream 142 and the high-band side information 172 may be multiplexed by the multiplexer 170 to generate an output bit stream 199. The output bit stream 199 may represent an encoded audio signal corresponding to the input audio signal 102. The output bit stream 199 may be transmitted (e.g., over a wired, wireless, or optical channel) by a transmitter 198 and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 199 may represent low-band data. The high-band side information 172 may be used at a receiver to regenerate the high-band excitation signals 162, 164 from the low-band data in accordance with a signal model. For example, the signal model may represent an expected set of relationships or correlations between low-band data (e.g., the low-band signal 122) and high-band data (e.g., the high-band signals 124, 125). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band signals 124, 125 from the output bit stream 199.

Figure 2A:
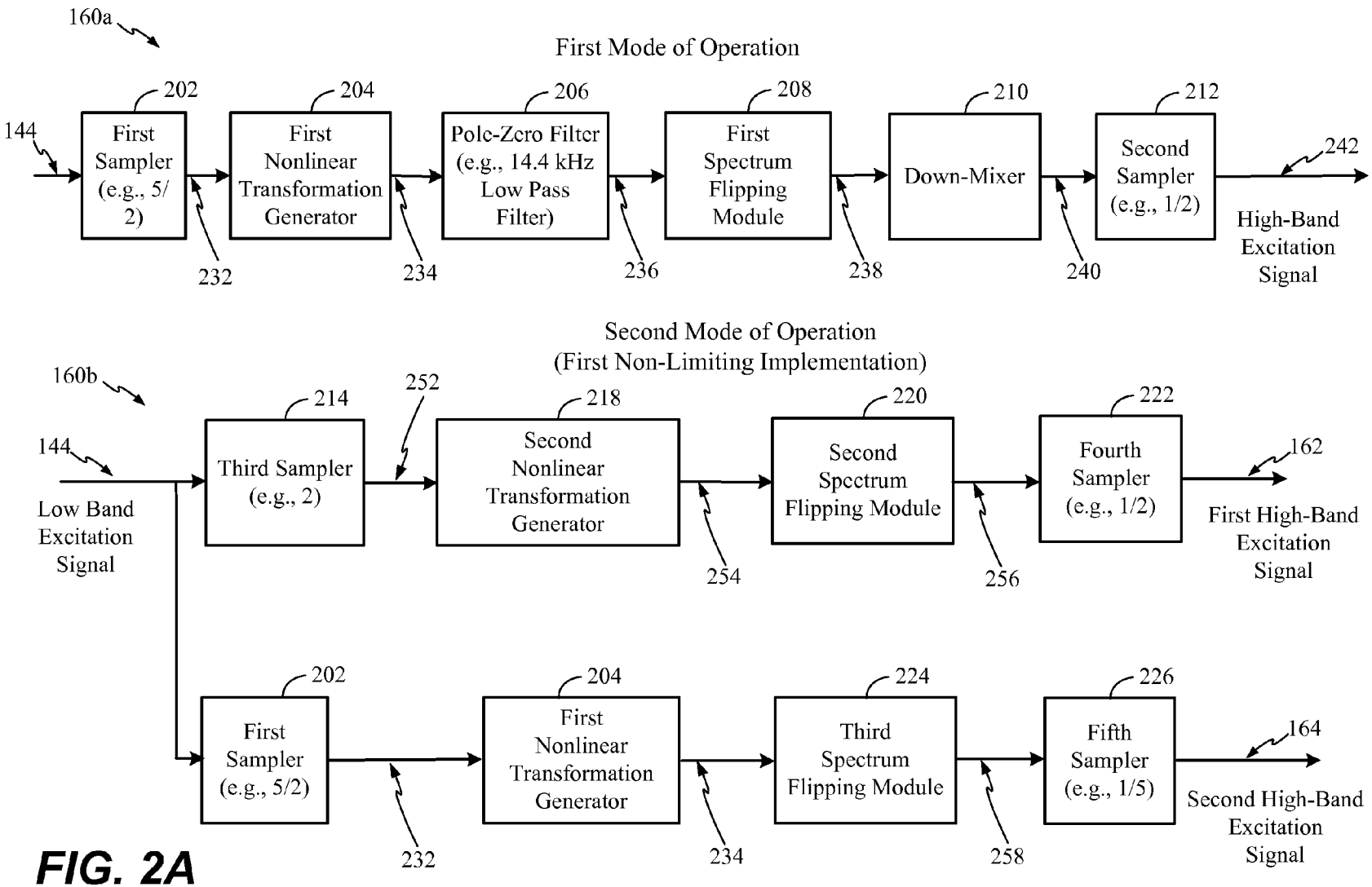
FIG. 2A is a diagram to illustrate particular examples of the high-band excitation generator of FIG. 1.
Figure 2B:
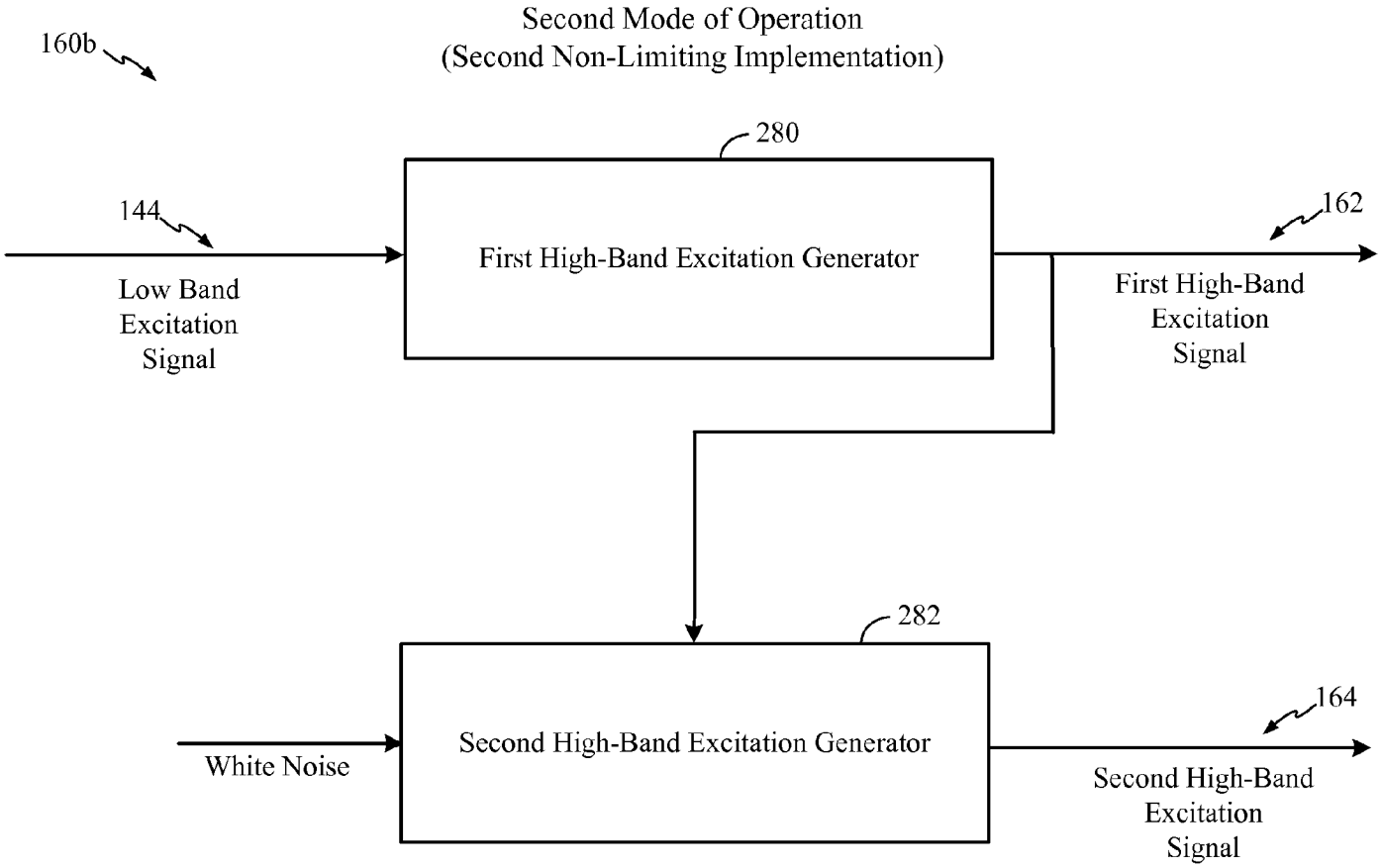
FIG. 2B is a diagram to illustrate another particular example of the high-band excitation generator of FIG. 1.

The system 100 of FIG. 1 may generate the high-band excitation signals 162, 164 according to a multi-band mode that is described in further detail with respect to FIGS. 2A, 2B, and 4, and the system 100 may reduce complex and computationally expensive operations associated with the pole-zero filtering and the down-mixing operations according to a single-band mode that is described in further detail with respect to FIGS. 2A-3. Additionally, the high-band excitation generator 160 may generate high-band excitation signals 162, 164 that, collectively, represent a larger frequency range of the input audio signal 102 (e.g., 6.4 kHz-16 kHz) than the frequency range of the input audio signal 102 represented by the high-band excitation signal 242 (e.g., 6.4 kHz-14.4 kHz) generated according to the single-band mode.

Referring to FIG. 2A, a particular aspect of first components 160*a* used in the high-band excitation generator 160 of FIG. 1 according to a first mode and a first non-limiting implementation of second components 160*b* used in the high-band excitation generator 160 according to a second mode is shown. For example, the first components 160*a* and the first implementation of the second components 160*b* may be integrated within the high-band excitation generator 160 of FIG. 1.

The first components 160*a* of the high-band excitation generator 160 may be configured to operate according to the first mode and may generate a high-band excitation signal 242 occupying a baseband frequency range between approximately 0 Hz and 8 kHz (corresponding to components of the input audio signal 102 between approximately 6.4 kHz and 14.4 kHz) based on the low-band excitation signal 144 occupying the frequency range between approximately 0 Hz and 6.4 kHz. The first components 160*a* of the high-band excitation generator 160 includes a first sampler 202, a first nonlinear transformation generator 204, a pole-zero filter 206, a first spectrum flipping module 208, a down-mixer 210, and a second sampler 212.

The low-band excitation signal 144 may be provided to the first sampler 202. The low-band excitation signal 144 may be received by the first sampler 202 as a set of samples correspond to a sampling rate of 12.8 kHz (e.g., the Nyquist sampling rate of a 6.4 kHz low-band excitation signal 144). For example, the low-band excitation signal 144 may be sampled at twice the rate of the bandwidth of the low-band excitation signal 144. Referring to FIG. 3, a particular illustrative non-limiting example of the low-band excitation signal 144 is shown with respect to graph (a). The diagrams illustrated in FIG. 3 are illustrative and some features may be emphasized for clarity. The diagrams are not necessarily drawn to scale.

The first sampler 202 may be configured to up-sample the low-band excitation signal 144 by a factor of two and a half (e.g., 2.5). For example, the first sampler 202 may up-sample the low-band excitation signal 144 by five and down-sample the resulting signal by two to generate an up-sampled signal 232. Up-sampling the low-band excitation signal 144 by two and a half may extend the band of the low-band excitation signal 144 from 0 Hz-16 kHz (e.g., 6.4 kHz*2.5=16 kHz). Referring to FIG. 3, a particular illustrative non-limiting example of the up-sampled signal 232 is shown with respect to graph (b). The up-sampled signal 232 may be sampled at 32 kHz (e.g., the Nyquist sampling rate of 16 kHz up-sampled signal 232). The up-sampled signal 232 may be provided to the first nonlinear transformation filter 204.

The first nonlinear transformation generator 204 may be configured to generate a first harmonically extended signal 234 based on the up-sampled signal 232. For example, the first nonlinear transformation generator 204 may perform a nonlinear transformation operation (e.g., an absolute-value operation or a square operation) on the up-sampled signal 232 to generate the first harmonically extended signal 234. The nonlinear transformation operation may extend the harmonics of the original signal (e.g., the low-band excitation signal 144 from 0 Hz to 6.4 kHz) into a higher band (e.g., from 0 Hz to 16 kHz). Referring to FIG. 3, a particular illustrative non-limiting example of the first harmonically extended signal 234 is shown with respect to graph (c). The first harmonically extended signal 234 may be provided to the pole-zero filter 206.

The pole-zero filter 206 may be a low-pass filter having a cutoff frequency at approximately 14.4 kHz. For example, the pole-zero filter 206 may be a high-order filter having a sharp drop-off at the cutoff frequency and configured to filter out high-frequency components of the first harmonically extended signal 234 (e.g., filter out components of the first harmonically extended signal 234 between 14.4 kHz and 16 kHz) to generate a filtered harmonically extended signal 236 occupying a bandwidth between 0 Hz and 14.4 kHz. Referring to FIG. 3, a particular illustrative non-limiting example of the filtered harmonically extended signal 236 is shown with respect to graph (d). The filtered harmonically extended signal 236 may be provided to the first spectrum flipping module 208.

The first spectrum flipping module 208 may be configured to perform a spectrum mirror operation (e.g., "flip" the spectrum) of the filtered harmonically extended signal 236 to generate a "flipped" signal. Flipping the spectrum of the filtered harmonically extended signal 236 may change (e.g., "flip") the contents of the filtered harmonically extended signal 236 to opposite ends of the spectrum ranging from 0 Hz to 16 kHz of the flipped signal. For example, content at 14.4 kHz of the filtered harmonically extended signal 236 may be at 1.6 kHz of the flipped signal, content at 0 Hz of the filtered harmonically extended signal 236 may be at 16 kHz of the flipped signal, etc. The first spectrum flipping module 208 may also include a low-pass filter (not shown) having a cutoff frequency at approximately 9.6 kHz. For example, the low-pass filter may be configured to filter out high-frequency components of the "flipped" signal (e.g., filter out components of the flipped signal between 9.6 kHz and 16 kHz) to generate a resulting signal 238 occupying a frequency range between 1.6 kHz and 9.6 kHz. Referring to FIG. 3, a particular illustrative non-limiting example of the resulting signal 238 is shown with respect to graph (e). The resulting signal 238 may be provided to the down-mixer 210.

The down-mixer 210 may be configured to down-mix the resulting signal 238 from the frequency range between 1.6 kHz and 9.6 kHz to baseband (e.g., a frequency range between 0 Hz and 8 kHz) to generate a down-mixed signal 240. The down-mixer 210 may be implemented using two-stage Hilbert transforms. For example, the down-mixer 210 may be implemented using two fifth-order infinite impulse response (IIR) filters having imaginary and real components, which may result in complex and computationally expensive operations. Referring to FIG. 3, a particular illustrative non-limiting example of the down-mixed signal 240 is shown with respect to graph (f). The down-mixed signal 240 may be provided to the second sampler 212.

The second sampler 212 may be configured to down-sample the down-mixed signal 240 by a factor of two (e.g., up-sample the down-mixed signal 240 by a factor of one-half) to generate the high-band excitation signal 242. Down-sampling the down-mixed signal 240 by two may reduce the frequency range of the down-mixed signal 240 to 0 Hz-8 kHz (e.g., 16 kHz*0.5=8 kHz) and reduce the sampling rate to 16 kHz. Referring to FIG. 3, a particular illustrative non-limiting example of the high-band excitation signal 242 is shown with respect to graph (f). The high-band excitation signal 242 (e.g., an 8 kHz band signal) may be sampled at 16 kHz (e.g., the Nyquist sampling rate of an 8 kHz high-band excitation signal 242) and may correspond to a baseband version of content in the frequency range between 6.4 kHz and 14.4 kHz of the first harmonically extended signal 234 in graph (c) of FIG. 3. Down-sampling at the second sampler 212 may result in a spectrum flip that returns content to its spectral orientation of the resulting signal (e.g., reversing the "flip" caused by the first spectrum flipping module 208). As used herein, it should be understood that down-sampling may result in a spectrum flip of content. The baseband version 126 of the first high-band signal 124 of FIG. 1 (e.g., 0 Hz-6.4 kHz) and the baseband version 127 of the second high-band signal 125 of FIG. 1 (e.g., 0 Hz-3.2 kHz) may be compared with corresponding frequency components of the high-band excitation signal 242 to generate high-band side information 172 (e.g., gain factors based on energy ratios).

To reduce complex and computationally expensive operations associated with the pole-zero filter 206 and the down-mixer 210 according to the first mode of operation, the high-band excitation generator 160 of the high-band analysis module 150 of FIG. 1 may operate according to the second mode, illustrated via the first implementation of the second components 160*b* of FIG. 2A, to generate the first high-band excitation signal 162 and the second high-band excitation signal 164. Additionally, the first implementation of the second components 160*b* of the high-band excitation generator 160 may generate high-band excitation signals 162, 164 that, collectively, represent a larger bandwidth of the input audio signal 102 (e.g., the 9.6 kHz bandwidth spanning the 6.4 kHz-16 kHz frequency range of the input audio signal 102) than the bandwidth represented by the high-band excitation signal 242 (e.g., an 8 kHz bandwidth spanning the 6.4 kHz-14.4 kHz frequency range of the input audio signal 102) according to the first mode of operation.

The first implementation of the second components 160*b* of the high-band excitation generator 160 may include a first path configured to generate the first high-band excitation signal 162 and a second path configured to generate the second high-band excitation signal 164. The first path and the second path may operate in parallel to decrease latency associated with generating the high-band excitation signals 162, 164. Alternatively, or in addition, one or more components may be shared in a serial or pipeline configuration to reduce size and/or cost.

The first path includes a third sampler 214, a second nonlinear transformation generator 218, a second spectrum flipping module 220, and a fourth sampler 222. The low-band excitation signal 144 may be provided to the third sampler 214. The third sampler 214 may be configured to up-sample the low-band excitation signal 144 by two to generate an up-sampled signal 252. Up-sampling the low-band excitation signal 144 by two may extend the band of the low-band excitation signal 144 from 0 Hz-12.8 kHz (e.g., 6.4 kHz*2=12.8 kHz). Referring to FIG. 4A, a particular illustrative non-limiting example of the up-sampled signal 252 is shown with respect to graph (g). The up-sampled signal 252 may be sampled at 25.6 kHz (e.g., the Nyquist sampling rate of a 12.8 kHz up-sampled signal 252). The diagrams illustrated in FIG. 4A are illustrative and some features may be emphasized for clarity. The diagrams are not necessarily drawn to scale. The up-sampled signal 252 may be provided to the second nonlinear transformation generator 218.

The second nonlinear transformation generator 218 may be configured to generate a second harmonically extended signal 254 based on the up-sampled signal 252. For example, the second nonlinear transformation generator 218 may perform a nonlinear transformation operation (e.g., an absolute-value operation or a square operation) on the up-sampled signal 252 to generate the second harmonically extended signal 254. The nonlinear transformation operation may extend the harmonics of the original signal (e.g., the low-band excitation signal 144 from 0 Hz to 6.4 kHz) into a higher band (e.g., from 0 Hz to 12.8 kHz). Referring to FIG. 4A, a particular illustrative non-limiting example of the second harmonically extended signal 254 is shown with respect to graph (h). The second harmonically extended signal 254 may be provided to the second spectrum flipping module 220.

The second flipping module 220 may be configured to perform a spectrum mirror operation (e.g., "flip" the spectrum) on the second harmonically extended signal 254 to generate a "flipped" signal. Flipping the spectrum of the second harmonically extended signal 254 may change (e.g., "flip") the contents of the second harmonically extended signal 254 to opposite ends of the spectrum ranging from 0 Hz to 12.8 kHz of the flipped signal. For example, content at 12.8 kHz of the second harmonically extended signal 254 may be at 0 Hz of the flipped signal, content at 0 Hz of the second harmonically extended signal 254 may be at 12.8 kHz of the flipped signal, etc. The first spectrum flipping module 208 may also include a low-pass filter (not shown) having a cutoff frequency at approximately 6.4 kHz. For example, the low-pass filter may be configured to filter out high-frequency components of the flipped signal (e.g., filter out components of the flipped signal between 6.4 kHz and 12.8 kHz) to generate a resulting signal 256 occupying a bandwidth between 0 Hz and 6.4 kHz. Referring to FIG. 4A, a particular illustrative non-limiting example of the resulting signal 256 is shown with respect to graph (i). The resulting signal 256 may be provided to the fourth sampler 222.

The fourth sampler 222 may be configured to down-sample the resulting signal 256 by two (e.g., up-sample the resulting signal 256 by a factor of one-half) to generate the first high-band excitation signal 162. Down-sampling the resulting signal 256 by two may reduce the band of the resulting signal 256 to 0 Hz-6.4 kHz (e.g., 12.8 kHz*0.5=6.4 kHz). Referring to FIG. 4A, a particular illustrative non-limiting example of the first high-band excitation signal 162 is shown with respect to graph (j). The first high-band excitation signal 162 (e.g., a 6.4 kHz band signal) may be sampled at 12.8 kHz (e.g., the Nyquist sampling rate of a 6.4 kHz first high-band excitation signal 162) and may correspond to a filtered baseband version of the first high-band signal 124 of FIG. 1 (e.g., a high-band speech signal occupying 6.4 kHz-12.8 kHz). For example, the baseband version 126 of the first high-band signal 124 may be compared with corresponding frequency components of the first high-band excitation signal 162 to generate high-band side information 172.

The second path includes the first sampler 202, the first nonlinear transformation generator 204, a third spectrum flipping module 224, and a fifth sampler 226. The low-band excitation signal 144 may be provided to the first sampler 202. The first sampler 202 may be configured to up-sample the low-band excitation signal 144 by two and a half (e.g., 2.5). For example, the first sampler 202 may up-sample the low-band excitation signal 144 by five and down-sample the resulting signal by two to generate the up-sampled signal 232. Referring to FIG. 4A, a particular illustrative non-limiting example of the up-sampled signal 232 is shown with respect to graph (k). The up-sampled signal 232 may be provided to the first nonlinear transformation generator 204.

The first nonlinear transformation generator 204 may be configured to generate the first harmonically extended signal 234 based on the up-sampled signal 232. For example, the first nonlinear transformation generator 204 may perform the nonlinear transformation operation on the up-sampled signal 232 to generate the first harmonically extended signal 234. The nonlinear transformation operation may extend the harmonics of the original signal (e.g., the low-band excitation signal 144 from 0 Hz to 6.4 kHz) into a higher band (e.g., from 0 Hz to 16 kHz). Referring to FIG. 4A, a particular illustrative non-limiting example of the first harmonically extended signal 234 is shown with respect to graph (1). The first harmonically extended signal 234 may be provided to the third spectrum flipping module 224.

The third spectrum flipping module 224 may be configured to "flip" the spectrum of the first harmonically extended signal 234. The third spectrum flipping module 224 may also include a low-pass filter (not shown) having a cutoff frequency at approximately 3.2 kHz. For example, the low-pass filter may be configured to filter out high-frequency components of the "flipped" signal (e.g., filter out components of the flipped signal between 3.2 kHz and 16 kHz) to generate a resulting signal 258 occupying a bandwidth between 0 kHz and 3.2 kHz. Referring to FIG. 4A, a particular illustrative non-limiting example of the resulting signal 258 is shown with respect to graph (m). The resulting signal 258 may be provided to the fifth sampler 226.

The fifth sampler 226 may be configured to down-sample the resulting signal 258 by five (e.g., up-sample the resulting signal 258 by a factor of one-fifth) to generate the second high-band excitation signal 164. Down-sampling the resulting signal 258 (e.g., with a sample rate of 32 kHz) by five may reduce the band of the resulting signal 258 to 0 Hz-3.2 kHz (e.g., 16 kHz*0.2=3.2 kHz). Referring to FIG. 4A, a particular illustrative non-limiting example of the second high-band excitation signal 164 is shown with respect to graph (n). The second high-band excitation signal 164 (e.g., a 3.2 kHz band signal) may be sampled at 6.4 kHz (e.g., the Nyquist sampling rate of a 3.2 kHz second high-band excitation signal 164) and may correspond to a filtered baseband version of the second high-band signal 125 of FIG. 1 (e.g., a high-band speech signal occupying 12.8 kHz-16 kHz). For example, the baseband version 127 of the second high-band signal 125 may be compared with corresponding frequency components of the second high-band excitation signal 164 to generate high-band side information 172.

It will be appreciated that the first implementation of the second components 160*b* of the high-band excitation generator 160 configured to generate the high-band excitation signals 162, 164 according to the second mode (e.g., the multi-band mode) may bypass the pole-zero filter 206 and the down-mixer 210 and reduce complex and computationally expensive operations associated with the pole-zero filter 206 and the down-mixer 210. Additionally, the first implementation of the second components 160*b* of the high-band excitation generator 160 may generate high-band excitation signals 162, 164 that, collectively, represent a larger bandwidth of the input audio signal 102 (e.g., 6.4 kHz-16 kHz) than the bandwidth represented by the high-band excitation signal 242 (e.g., 6.4 kHz-14.4 kHz) generated according to the first mode of operation.

Referring to FIG. 2B, a second non-limiting implementation of the second components 160*b* used in the high-band excitation generator 160 according to a second mode is shown. The second implementation of the second components 160*b* of the high-band excitation generator 160 may include a first high-band excitation generator 280 and a second high-band excitation generator 282.

The low-band excitation signal 144 may be provided to the first high-band excitation generator 280. The first high-band excitation generator 280 may generate a first baseband signal (e.g., the first high-band excitation signal 162) based on up-sampling the low-band excitation signal 144. For example, the first high-band excitation generator 280 may include the third sampler 214 of FIG. 2A, the second nonlinear transformation generator 218 of FIG. 2A, the second spectrum flipping module 220 of FIG. 2A, and the fourth sampler 222 of FIG. 2A. Thus, the first high-band excitation generator 280 may operate in a substantially similar manner as the first path of the first implementation of the second components 160*b* of FIG. 2A.

The first high-band excitation signal 162 may be provided to the second high-band excitation generator 282. The second high-band excitation generator 282 may be configured to modulate white noise using the first high-band excitation signal 162 to generate the second high-band excitation signal 164. For example, the second high-band excitation signal 164 may be generated by applying a spectral envelope of the first high-band excitation signal 162 to an output of a white noise generator (e.g., a circuit that generates a random or pseudo-random signal). Thus, according to the second non-limiting implementation of the second components 160*b*, the second path of the first non-limiting implementation of the second components 160*b* may be "replaced" with the second high-band excitation generator 282 to generate the second high-band excitation signal 164 based on the first high-band excitation signal 162 and white noise.

Although FIGS. 2A-2B describe the first components 160*a* and the second components 160*b* as being associated with distinct operation modes of the high-band excitation generator 160, in other aspects, the high-band excitation generator 160 of FIG. 1 may be configured to operate in the second mode without being configured to also operate in the first mode (e.g., the high-band excitation generator 160 may omit the pole-zero filter 206 and the down-mixer 210). Although the first implementation of the second components 160*b* is depicted in FIG. 2A as including two non-linear transformation generators 204, 218, in other aspects a single nonlinear transformation generator may be used to generate a single harmonically extended signal based on the low-band excitation signal 144. The single harmonically extended signal may be provided to the first path and the second path for additional processing.

FIGS. 2A-4A illustrate SWB coding high-band excitation generation. The techniques and sampling ratios described with respect to FIGS. 2A-4A may be applied to full band (FB) coding. As a non-limiting example, the second mode of operation described with respect to FIGS. 2A, 2B, and 4A may be applied to FB coding. Referring to FIG. 4B, the second mode of operation is illustrated with respect to FB coding. The second mode of operation in FIG. 4B is described with respect to the second components 160*b* of the high-band excitation generator 160.

A low-band excitation signal having a frequency range spanning approximately from 0 Hz to 8 kHz may be provided to the third sampler 214. The third sampler 214 may be configured to up-sample the low-band excitation signal by two to generate an up-sampled signal 252*b*. Up-sampling the low-band excitation signal 144 by two may extend the frequency range of the low-band excitation signal from 0 Hz-16 kHz (e.g., 8 kHz*2=16 kHz). Referring to FIG. 4B, a particular illustrative non-limiting example of the up-sampled signal 252*b* is shown with respect to graph (a). The up-sampled signal 252*b* may be sampled at 32 kHz (e.g., the Nyquist sampling rate of a 16 kHz up-sampled signal 252). The diagrams are not necessarily drawn to scale. The up-sampled signal 252*b* may be provided to the second nonlinear transformation generator 218.

The second nonlinear transformation generator 218 may be configured to generate a second harmonically extended signal 254*b* based on the up-sampled signal 252*b*. For example, the second nonlinear transformation generator 218 may perform a nonlinear transformation operation (e.g., an absolute-value operation or a square operation) on the up-sampled signal 252*b* to generate the second harmonically extended signal 254*b*. The nonlinear transformation operation may extend the harmonics of the original signal (e.g., the low-band excitation signal from 0 Hz to 8 kHz) into a higher band (e.g., from 0 Hz to 16 kHz). Referring to FIG. 4B, a particular illustrative non-limiting example of the second harmonically extended signal 254*b* is shown with respect to graph (b). The second harmonically extended signal 254*b* may be provided to the second spectrum flipping module 220.

The second flipping module 220 may be configured to perform a spectrum mirror operation (e.g., "flip" the spectrum) on the second harmonically extended signal 254*b* to generate a "flipped" signal. Flipping the spectrum of the second harmonically extended signal 254*b* may change (e.g., "flip") the contents of the second harmonically extended signal 254*b* to opposite ends of the spectrum ranging from 0 Hz to 16 kHz of the flipped signal. For example, content at 16 kHz of the second harmonically extended signal 254*b* may be at 0 Hz of the flipped signal, content at 0 Hz of the second harmonically extended signal 254*b* may be at 16 kHz of the flipped signal, etc. The first spectrum flipping module 208 may also include a low-pass filter (not shown) having a cutoff frequency at approximately 8 kHz. For example, the low-pass filter may be configured to filter out high-frequency components of the flipped signal (e.g., filter out components of the flipped signal between 8 kHz and 16 kHz) to generate a resulting signal 256*b* occupying a bandwidth between 0 Hz and 8 kHz. Referring to FIG. 4B, a particular illustrative non-limiting example of the resulting signal 256*b* is shown with respect to graph (c). The resulting signal 256*b* may be provided to the fourth sampler 222.

The fourth sampler 222 may be configured to down-sample the resulting signal 256*b* by two (e.g., up-sample the resulting signal 256*b* by a factor of one-half) to generate a first high-band excitation signal 162*b* spanning from approximately 0 Hz to 8 kHz. Down-sampling the resulting signal 256*b* by two may reduce the band of the resulting signal 256*b* to 0 Hz-8 kHz (e.g., 16 kHz*0.5=8 kHz). Referring to FIG. 4B, a particular illustrative non-limiting example of the first high-band excitation signal 162*b* is shown with respect to graph (d). The first high-band excitation signal 162*b* (e.g., an 8 kHz band signal) may be sampled at 16 kHz (e.g., the Nyquist sampling rate of a 8 kHz the first high-band excitation signal 162*b*) and may correspond to a filtered baseband version of a first high-band signal (e.g., a high-band speech signal occupying 8 kHz-16 kHz). For example, the baseband version 126 of the first high-band signal 124 may be compared with corresponding frequency components of the first high-band excitation signal 162*b* to generate high-band side information 172.

The low-band excitation signal may be provided to the first sampler 202. The first sampler 202 may be configured to up-sample the low-band excitation signal by two and a half (e.g., 2.5). For example, the first sampler 202 may up-sample the low-band excitation signal 144 by five and down-sample the resulting signal by two to generate an up-sampled signal 232*b*. Referring to FIG. 4B, a particular illustrative non-limiting example of the up-sampled signal 232*b* is shown with respect to graph (e). The up-sampled signal 232*b* may be provided to the first nonlinear transformation generator 204.

The first nonlinear transformation generator 204 may be configured to generate a first harmonically extended signal 234*b* based on the up-sampled signal 232*b*. For example, the first nonlinear transformation generator 204 may perform the nonlinear transformation operation on the up-sampled signal 232*b* to generate the first harmonically extended signal 234*b*. The nonlinear transformation operation may extend the harmonics of the original signal (e.g., the low-band excitation signal from 0 Hz to 8 kHz) into a higher band (e.g., from 0 Hz to 20 kHz). Referring to FIG. 4B, a particular illustrative non-limiting example of the first harmonically extended signal 234*b* is shown with respect to graph (f). The first harmonically extended signal 234*b* may be provided to the third spectrum flipping module 224.

The third spectrum flipping module 224 may be configured to "flip" the spectrum of the first harmonically extended signal 234*b*. The third spectrum flipping module 224 may also include a low-pass filter (not shown) having a cutoff frequency at approximately 4 kHz. For example, the low-pass filter may be configured to filter out high-frequency components of the "flipped" signal (e.g., filter out components of the flipped signal between 4 kHz and 20 kHz) to generate a resulting signal 258*b* occupying a bandwidth between 0 kHz and 4 kHz. Referring to FIG. 4B, a particular illustrative non-limiting example of the resulting signal 258*b* is shown with respect to graph (g). The resulting signal 258*b* may be provided to the fifth sampler 226.

The fifth sampler 226 may be configured to down-sample the resulting signal 258*b* by five (e.g., up-sample the resulting signal 258 by a factor of one-fifth) to generate a second high-band excitation signal 164*b*. Down-sampling the resulting signal 258*b* (e.g., with a sample rate of 40 kHz) by five may reduce the band of the resulting signal 258*b* to 0 Hz-4 kHz (e.g., 20 kHz*0.2=4 kHz). Referring to FIG. 4B, a particular illustrative non-limiting example of the second high-band excitation signal 164*b* is shown with respect to graph (h). The second high-band excitation signal 164*b* (e.g., a 4 kHz band signal) may be sampled at 8 kHz (e.g., the Nyquist sampling rate of a 4 kHz second high-band excitation signal 164*b*) and may correspond to a filtered baseband version of a high-band speech signal occupying 16 kHz-20 kHz. For example, the baseband version 127 of the second high-band signal 125 may be compared with corresponding frequency components of the second high-band excitation signal 164*b* to generate high-band side information 172.

It will be appreciated that the second components 160*b* of the high-band excitation generator 160 configured to generate the high-band excitation signals 162*b*, 164*b* according to the second mode (e.g., the multi-band mode) may bypass the pole-zero filter 206 and the down-mixer 210 and reduce complex and computationally expensive operations associated with the pole-zero filter 206 and the down-mixer 210. Additionally, the second components 160*b* of the high-band excitation generator 160 may generate high-band excitation signals 162*b*, 164*b* that, collectively, represent a larger bandwidth of the input audio signal 102 (e.g., 8 kHz-20 kHz).

Referring to FIG. 5, a particular aspect of first components 106*a* used in the high-band generation circuitry 106 of FIG. 1 configured to operate according to a first mode and a particular aspect of second components 106*b* used in the high-band generation circuitry 106 configured to operate according to a second mode is shown.

The first components 106*a* of the high-band generation circuitry 106 configured to operate according to the first mode may generate a baseband version of a high-band signal 540 occupying a baseband frequency range between approximately 0 Hz and 8 kHz (corresponding to components of the input audio signal 102 between approximately 6.4 kHz and 14.4 kHz) based on the input audio signal 102. The first components 106*a* of the high-band generation circuitry 106 include a pole-zero filter 502, a first spectrum flipping module 504, a down-mixer 506, and a first sampler 508.

The input audio signal 102 may be sampled at 32 kHz (e.g., the Nyquist sampling rate of a 16 kHz input audio signal 102). For example, the input audio signal 102 may be sampled at twice the rate of the bandwidth of the input audio signal 102. Referring to FIG. 6, a particular illustrative non-limiting example of the input audio signal is shown with respect to graph (a). The input audio signal 102 may include low-band speech occupying the frequency range between 0 Hz and 6.4 kHz, and the input audio signal 102 may include high-band speech occupying the frequency range between 6.4 kHz and 16 kHz. The diagrams illustrated in FIG. 6 are illustrative and some features may be emphasized for clarity.

The diagrams are not necessarily drawn to scale. The input audio signal 102 may be provided to the pole-zero filter 502.

The pole-zero filter 502 may be a low-pass filter having a cutoff frequency at approximately 14.4 kHz. For example, the pole-zero filter 502 may be a high-order filter having a sharp drop-off at the cutoff frequency and configured to filter out high-frequency components of the input audio signal 102 (e.g., filter out components of the input audio signal 102 between 14.4 kHz and 16 kHz) to generate a filtered input audio signal 532 occupying a bandwidth between 0 Hz and 14.4 kHz. Referring to FIG. 6, a particular illustrative non-limiting example of the filtered input audio signal 532 is shown with respect to graph (b). The filtered input audio signal 532 may be provided to the first spectrum flipping module 504.

The first spectrum flipping module 504 may be configured to perform mirror operation (e.g., "flip" the spectrum) on the filtered input audio signal 532 to generate a "flipped" signal. Flipping the spectrum of the filtered input audio signal 532 may change (e.g., "flip") the contents of the filtered input audio signal 532 to opposite ends of the spectrum ranging from 0 Hz to 16 kHz. For example, content at 14.4 kHz of the filtered input audio signal 532 may be at 1.6 kHz of the flipped signal, content at 0 Hz of the filtered input audio signal 532 may be at 16 kHz of the flipped signal, etc. The first spectrum flipping module 208 may also include a low-pass filter (not shown) having a cutoff frequency at approximately 9.6 kHz. For example, the low-pass filter may be configured to filter out high-frequency components of the flipped signal (e.g., filter out components of the flipped signal between 9.6 kHz and 16 kHz) to generate a resulting signal 534 (representative of the high-band) occupying a bandwidth between 1.6 kHz and 9.6 kHz. Referring to FIG. 6, a particular illustrative non-limiting example of the resulting signal 534 is shown with respect to graph (c). The resulting signal 534 may be provided to the down-mixer 506.

The down-mixer 506 may be configured to down-mix the resulting signal 534 from the frequency range between 1.6 kHz and 9.6 kHz to baseband (e.g., a frequency range between 0 Hz and 8 kHz) to generate a down-mixed signal 536. Referring to FIG. 6, a particular illustrative non-limiting example of the down-mixed signal 536 is shown with respect to graph (d). The down-mixed signal 536 may be provided to the first sampler 508.

The first sampler 508 may be configured to may be configured to down-sample the down-mixed signal 536 by a factor of two (e.g., up-sample the down-mixed signal 536 by a factor of one-half) to generate the baseband version of the high-band signal 540. Down-sampling the down-mixed signal 536 by two may reduce the band of the down-mixed signal 536 to 0 Hz-16 kHz (e.g., 32 kHz*0.5=16 kHz). Referring to FIG. 6, a particular illustrative non-limiting example of the baseband version of the high-band signal 540 is shown with respect to graph (e). The baseband version of the high-band signal 540 (e.g., an 8 kHz band signal) may have the sample rate of 16 kHz and may correspond to a baseband version of components of the input audio signal 102 occupying the frequency range between 6.4 kHz and 14.4 kHz. For example, the baseband version of the high-band signal 540 may be compared with corresponding frequency components of the high-band excitation signal 242 of FIG. 2A or corresponding frequency components of the first and second high-band excitation signals 162, 164 of FIGS. 1-2B to generate high-band side information 172.

To reduce complex and computationally expensive operations associated with the pole-zero filter 502 and the down-mixer 506 according to the first mode of operation, the high-band generation circuitry 106 may be configured to operate according to the second mode to generate the baseband versions 126, 127 of the high-band signals 124, 125. Additionally, the high-band generation circuitry 106 may generate the baseband versions 126, 127 of the high-band signals 124, 125 that, collectively, represent a larger bandwidth component of the input audio signal 102 (e.g., a 9.6 kHz bandwidth in the frequency range 6.4 kHz-16 kHz) than the bandwidth component represented by the baseband version of the high-band signal 540 (e.g., a 8 kHz bandwidth in the frequency range 6.4 kHz-14.4 kHz) according to the first mode of operation.

The second components 106*b* of the high-band generation circuitry 106 may include a first path configured to generate the baseband version 126 of the first high-band band signal 124 and a second path configured to generate the baseband version 127 of the second high-band signal 125. The first path and the second path may operate in parallel to decrease processing times associated with generating the baseband versions 126, 127 of high-band signals 124, 125. Alternatively, or in addition, one or more components may be shared in a serial or pipeline configuration to reduce size and/or cost.

The first path includes a second sampler 510, a second spectrum flipping module 512, and a third sampler 516. The input audio signal 102 may be provided to the second sampler 510. The second sampler 510 may be configured to down-sample the input audio signal 102 by five-fourths (e.g., up-sample the input audio signal 102 by fourth-fifths) to generate a down-sampled signal 542. Down-sampling the input audio signal 102 by five-fourths may reduce the band of the input audio signal 102 to 0 Hz-12.8 kHz (e.g., 16 kHz*(4/5)=12.8 kHz). Referring to FIG. 7A, a particular illustrative non-limiting example of the down-sampled signal 542 is shown with respect to graph (f). The down-sampled signal 542 may be sampled at 25.6 kHz (e.g., the Nyquist sampling rate of a 12.8 kHz down-sampled signal 542). The diagrams illustrated in FIG. 7A are illustrative and some features may be emphasized for clarity. The diagrams are not necessarily drawn to scale. The down-sampled signal 542 may be provided to the second spectrum flipping module 512.

The second spectrum flipping module 512 may be configured to perform mirror operation (e.g., "flip" the spectrum) on the down-sampled signal 542 to generate a "flipped" signal. Flipping the spectrum of the down-sampled signal 542 may change (e.g., "flip") the contents of the filtered down-sampled signal 542 to opposite ends of the spectrum ranging from 0 Hz to 12.8 kHz. For example, content at 12.8 kHz of the down-sampled signal 542 may be at 0 Hz of the flipped signal, content at 0 Hz of the down-sampled signal 542 may be at 12.8 kHz of the flipped signal, etc. The second spectrum flipping module 512 may also include a low-pass filter (not shown) having a cutoff frequency at approximately 6.4 kHz. For example, the low-pass filter may be configured to filter out high-frequency components of the flipped signal (e.g., filter out components of the flipped signal between 6.4 kHz and 12.8 kHz) to generate a resulting signal 544 (representative of the high-band) occupying a bandwidth between 0 Hz and 6.4 kHz. Referring to FIG. 7A, a particular illustrative non-limiting example of the resulting signal 544 is shown with respect to graph (g). The resulting signal 544 may be provided to the third sampler 516.

The third sampler 516 may be configured to down-sample the resulting signal 544 by a factor of two (e.g., up-sample the resulting signal 544 by a factor of one-half) to generate the baseband version 126 of the first high-band signal 124. Down-sampling the resulting signal 544 by two may reduce the band of the resulting signal 544 from 0 Hz-12.8 kHz (e.g., 25.6 kHz*0.5=12.8 kHz). Referring to FIG. 7A, a particular illustrative non-limiting example of the baseband version 126 of the first high-band signal 124 is shown with respect to graph (h). The baseband version 126 of the first high-band signal 124 (e.g., a 6.4 kHz band signal) may be sampled at 12.8 kHz (e.g., the Nyquist sampling rate of a 6.4 kHz baseband version 126 of the first high-band signal 124) and may correspond to a baseband version of components of the input audio signal 102 occupying the frequency range between 6.4 kHz and 12.8 kHz. For example, the baseband version 126 of the first high-band signal 124 may be compared with corresponding frequency components of the first high-band excitation signal 162 of FIGS. 1-2B to generate high-band side information 172.

The second path includes a third spectrum flipping module 518 and a fourth sampler 520. The input audio signal 102 may be provided to the third spectrum flipping module 518. The third spectrum flipping module 518 may include a high-pass filter (not shown) having a cutoff frequency at approximately 12.8 kHz. For example, the high-pass filter may be configured to filter out low-frequency components of the input audio signal (e.g., filter out components of the input audio signal between 0 Hz and 12.8 kHz) to generate a filtered input audio signal occupying a frequency range between 12.8 kHz and 16 kHz. The third spectrum flipping module 518 may also be configured to "flip" the spectrum of the filtered input audio signal to generate a resulting signal 546. Referring to FIG. 7A, a particular illustrative non-limiting example of the resulting signal 546 is shown with respect to graph (i). The resulting signal 546 may be provided to the fourth sampler 520.

The fourth sampler 520 may be configured to down-sample the resulting signal 546 by five (e.g., up-sample the resulting signal 546 by a factor of one-fifth) to generate the baseband version 127 of the second high-band signal 125 having a sample rate of 6.4 kHz. Down-sampling the resulting signal 546 by five may reduce the band of the resulting signal 546 from 0 Hz-3.2 kHz (e.g., 16 kHz*0.2=3.2 kHz). Referring to FIG. 7A, a particular illustrative non-limiting example of the second high-band signal 125 is shown with respect to graph (j). The baseband version 127 of the second high-band signal 125 (e.g., a 3.2 kHz band signal) may have a sample rate of 6.4 kHz (e.g., the Nyquist sampling rate of a 3.2 kHz second high-band signal 125) and may correspond to a baseband version of components occupying the frequency range between 12.8 kHz and 16 kHz of the input audio signal 102. For example, the baseband version 127 of the second high-band signal 125 may be compared with corresponding frequency components of the second high-band excitation signal 164 of FIGS. 1-2B to generate high-band side information 172.

It will be appreciated that the second components 106*b* of the high-band generation circuitry 106 configured to generate the baseband versions 126, 127 of the high-band signals 124, 125 according to the second mode (e.g., the multi-band mode) may reduce complex and computationally expensive operations associated with the pole-zero filter 502 and the down-mixer 506 as compared to operating according to the first mode (e.g., the single-band mode). Additionally, the high-band generation circuitry 106 may generate baseband versions 126, 127 of the high-band signals 124, 125 that, collectively, represent a larger bandwidth of the input audio signal 102 (e.g., a 9.6 kHz bandwidth of the frequency range 6.4 kHz-16 kHz) than the bandwidth represented by the baseband version of the high-band signal 540 (e.g., a 8 kHz bandwidth of the frequency range 6.4 kHz-14.4 kHz) generated according to the first mode of operation. Although FIG. 5 describes the first components 106*a* and the second components 106*b* as being associated with distinct modes of the high-band generation circuitry 106, in other aspects, the high-band generation circuitry 106 of FIG. 1 may be configured to operate in the second mode without being configured to also operate in the first mode (e.g., the high-band generation circuitry 106 may omit the pole-zero filter 502 and the down-mixer 506).

FIGS. 5-7A illustrate SWB coding high-band generation. The techniques and sampling ratios described with respect to FIGS. 5-7A may be applied to full band (FB) coding. As a non-limiting example, the second mode of operation described with respect to FIGS. 5 and 7A may be applied to FB coding. Referring to FIG. 7B, the second mode of operation is illustrated with respect to FB coding. The second mode of operation in FIG. 7B is described with respect to the second components 106*b* of the high-band generation circuitry 106.

An input audio signal having a frequency spanning from 0 Hz to 20 kHz may be provided to the second sampler 510. The second sampler 510 may be configured to down-sample the input audio signal by five-fourths (e.g., up-sample the input audio signal by fourth-fifths) to generate a down-sampled signal 542*b*. Down-sampling the input audio signal by five-fourths may reduce the band of the input audio signal to 0 Hz-16 kHz (e.g., 20 kHz*(4/5)=16 kHz). Referring to FIG. 7B, a particular illustrative non-limiting example of the down-sampled signal 542*b* is shown with respect to graph (a). The down-sampled signal 542*b* may be sampled at 32 kHz (e.g., the Nyquist sampling rate of a 16 kHz down-sampled signal 542*b*). The down-sampled signal 542*b* may be provided to the second spectrum flipping module 512.

The second spectrum flipping module 512 may be configured to perform mirror operation (e.g., "flip" the spectrum) on the down-sampled signal 542*b* to generate a "flipped" signal. Flipping the spectrum of the down-sampled signal 542*b* may change (e.g., "flip") the contents of the filtered down-sampled signal 542*b* to opposite ends of the spectrum ranging from 0 Hz to 16 kHz. For example, content at 16 kHz of the down-sampled signal 542*b* may be at 0 Hz of the flipped signal, content at 0 Hz of the down-sampled signal 542*b* may be at 16 kHz of the flipped signal, etc. The second spectrum flipping module 512 may also include a low-pass filter (not shown) having a cutoff frequency at approximately 8 kHz. For example, the low-pass filter may be configured to filter out high-frequency components of the flipped signal (e.g., filter out components of the flipped signal between 8 kHz and 16 kHz) to generate a resulting signal 544*b* (representative of the high-band) occupying a bandwidth between 0 Hz and 8 kHz. Referring to FIG. 7B, a particular illustrative non-limiting example of the resulting signal 544*b* is shown with respect to graph (b). The resulting signal 544*b* may be provided to the third sampler 516.

The third sampler 516 may be configured to down-sample the resulting signal 544*b* by a factor of two (e.g., up-sample the resulting signal 544*b* by a factor of one-half) to generate the baseband version 126 of the first high-band signal 124. Down-sampling the resulting signal 544*b* by two may reduce the band of the resulting signal 544*b* from 0 Hz-16 kHz (e.g., 32 kHz*0.5=16 kHz). Referring to FIG. 7B, a particular illustrative non-limiting example of the baseband version 126 of the first high-band signal 124 is shown with respect to graph (c). The baseband version 126 of the first high-band signal 124 (e.g., an 8 kHz band signal) may be sampled at 16 kHz (e.g., the Nyquist sampling rate of an 8 kHz baseband version 126 of the first high-band signal 124) and may correspond to a baseband version of components of the input audio signal occupying the frequency range between 8 kHz and 16 kHz.

The input audio signal spanning from 0 Hz to 20 kHz may also be provided to the third spectrum flipping module 518. The third spectrum flipping module 518 may include a high-pass filter (not shown) having a cutoff frequency at approximately 16 kHz. For example, the high-pass filter may be configured to filter out low-frequency components of the input audio signal (e.g., filter out components of the input audio signal between 0 Hz and 16 kHz) to generate a filtered input audio signal occupying a frequency range between 16 kHz and 20 kHz. The third spectrum flipping module 518 may also be configured to "flip" the spectrum of the filtered input audio signal to generate a resulting signal 546*b*. Referring to FIG. 7B, a particular illustrative non-limiting example of the resulting signal 546 is shown with respect to graph (d). The resulting signal 546*b* may be provided to the fourth sampler 520.

The fourth sampler 520 may be configured to down-sample the resulting signal 546*b* by five (e.g., up-sample the resulting signal 546*b* by a factor of one-fifth) to generate the baseband version 127 of the second high-band signal 125 having a sample rate of 8 kHz. Down-sampling the resulting signal 546*b* by five may reduce the band of the resulting signal 546*b* from 0 Hz-4 kHz (e.g., 20 kHz*0.2=4 kHz). Referring to FIG. 7B, a particular illustrative non-limiting example of the second high-band signal 125 is shown with respect to graph (e). The baseband version 127 of the second high-band signal 125 (e.g., a 4 kHz band signal) may have a sample rate of 8 kHz (e.g., the Nyquist sampling rate of a 4 kHz second high-band signal 125) and may correspond to a baseband version of components occupying the frequency range between 16 kHz and 20 kHz of the input audio signal spanning from 0 Hz to 20 kHz.

It will be appreciated that the second components 106*b* of the high-band generation circuitry 106 configured to generate the baseband versions 126, 127 of the high-band signals 124, 125 according to the second mode (e.g., the multi-band mode) may reduce complex and computationally expensive operations associated with the pole-zero filter 502 and the down-mixer 506 as compared to operating according to the first mode (e.g., the single-band mode).

Referring to FIG. 8, a particular aspect of a system 800 that is operable to reconstruct a high-band portion of an audio signal using dual high-band excitation is shown. The system 800 includes a high-band excitation generator 802, a high-band synthesis filter 804, a first adjuster 806, a second adjuster 808, and a dual-high-band signal generator 810. In a particular aspect, the system 800 may be integrated into a decoding system or apparatus (e.g., in a wireless telephone or CODEC). In other particular aspects, the system 800 may be integrated into a set top box, a music player, a video player, an entertainment unit, a navigation device, a communications device, a PDA, a fixed location data unit, or a computer, as illustrative, non-limiting examples. In some aspects, components of the system 800 may be included in a local decoder portion of an encoder (e.g., the high-band excitation generator 802 may correspond to the high-band excitation generator 160 of FIG. 1 and the high-band synthesis filter 804 may correspond to the LP synthesis module 166 of FIG. 1) that is configured to replicate decoder operations to determine the high-band side information 172 (e.g., gain ratios).

The high-band excitation generator 802 may be configured to generate a first high-band excitation signal 862 and a second high-band excitation signal 864 based on the low-band excitation signal 144 that is received as part of the low-band bit stream 142 in the bit stream 199 (e.g., the bit stream 199 may be received via a receiver of a mobile device). The first high-band excitation signal 862 may correspond to a reconstructed version of the first high-band excitation signal 162 of FIGS. 1-2B, and the second high-band excitation signal 864 may correspond to a reconstructed version of the second high-band excitation signal 164 of FIGS. 1-2B. For example, the high-band excitation generator 802 may include a first high-band excitation generator 896 and a second high-band excitation generator 898. The first high-band excitation generator 896 may operate in a substantially similar manner as the first high-band excitation generator 280 of FIG. 2B, and the second high-band excitation generator 898 may operate in a substantially similar manner as the second high-band excitation generator 282 of FIG. 2B. The first high-band excitation signal 862 may have a baseband frequency range between approximately 0 Hz and 6.4 kHz, and the second high-band excitation signal 864 may have a baseband frequency range between approximately 0 Hz and 3.2 kHz. The high-band excitation signals 862, 864 may be provided to the high-band synthesis filter 804.

The high-band synthesis filter 804 may be configured to generate a first baseband synthesized signal 822 and a second baseband synthesized signal 824 based on the high-band excitation signals 862, 864 and LPCs from the high-band side information 172. For example, the high-band side information 172 may be provided to the high-band synthesis filter 804 via the bit stream 199. The first baseband synthesized signal 822 may represent components of a 6.4 kHz-12.8 kHz frequency band of the input audio signal 102, and the second baseband synthesized signal 824 represent components of a 12.8 kHz-16 kHz frequency band of the input audio signal 102. The first baseband synthesized signal 822 may be provided to the first adjuster 806, and the second baseband synthesized signal 824 may be provided to the second adjuster 808.

The first adjuster 806 may be configured to generate a first gain-adjusted baseband synthesized signal 832 based on the first baseband synthesized signal 822 and gain adjustment parameters from the high-band side information 172. The second adjuster 808 may be configured to generate a second gain-adjusted baseband synthesized signal 834 based on the second baseband synthesized signal 824 and gain adjustment parameters from the high-band side information 172. The first gain-adjusted baseband synthesized signal 832 may have a baseband bandwidth of 6.4 kHz, and the second gain-adjusted baseband synthesized signal 834 may have a baseband bandwidth of 3.2 kHz. The gain adjusted baseband synthesized signals 832, 834 may be provided to the dual high-band signal generator 810.

The dual high-band signal generator 810 may be configured to shift the frequency spectrum of the first gain-adjusted baseband synthesized signal 832 into a first synthesized high-band signal 842. The first synthesized high-band signal 842 may have a frequency band ranging from approximately 6.4 kHz-12.8 kHz. For example, the first synthesized high-band signal 842 may correspond to a reconstructed version of the input audio signal 102 ranging from 6.4 kHz-12.8 kHz. The dual high-band signal generator 810 may also be configured to shift the frequency spectrum of the second gain-adjusted baseband synthesized signal 834 into a second synthesized high-band signal 844. The second synthesized high-band signal 844 may have a frequency range ranging from approximately 12.8 kHz-16 kHz. For example, the second synthesized high-band signal 844 may correspond to a reconstructed version of the input audio signal 102 ranging from 12.8 kHz-16 kHz. Operations of the dual high-band signal generator 810 are described in greater detail with respect to FIG. 9.

Referring to FIG. 9, a particular aspect of the dual high-band signal generator 810 is shown. The dual high-band signal generator 810 may include a first path configured to generate the first synthesized high-band signal 842 and a second path configured to generate the second synthesized high-band signal 844. The first path and the second path may operate in parallel to decrease processing times associated with generating the synthesized high-band signals 842, 844. Alternatively, or in addition, one or more components may be shared in a serial or pipeline configuration to reduce size and/or cost.

The first path includes a first sampler 902, a first spectrum flipping module 904, and a second sampler 906. The first gain-adjusted baseband synthesized signal 832 may be provided to the first sampler 902. Referring to FIG. 10, a particular illustrative non-limiting example of the first gain-adjusted baseband synthesized signal 832 is shown with respect to graph (a). The first gain-adjusted baseband synthesized signal 832 may have a baseband bandwidth of 6.4 kHz, and the first gain-adjusted baseband synthesized signal 832 may be sampled at 12.8 kHz (e.g., the Nyquist sampling rate). The diagrams illustrated in FIG. 10 are illustrative and some features may be emphasized for clarity. The diagrams are not necessarily drawn to scale.

The first sampler 902 may be configured to up-sample the first gain-adjusted baseband synthesized signal 832 by two to generate an up-sampled signal 922. Up-sampling the first gain-adjusted baseband synthesized signal 832 by two may extend the band of the first gain-adjusted baseband synthesized signal 832 from 0 Hz-12.8 kHz (e.g., 6.4 kHz*2=12.8 kHz). Referring to FIG. 10, a particular illustrative non-limiting example of the up-sampled signal 922 is shown with respect to graph (b). The up-sampled signal 922 may be sampled at 25.6 kHz (e.g., the Nyquist sampling rate). The up-sampled signal 922 may be provided to the first spectrum flipping module 904.

The first spectrum flipping module 904 may be configured to "flip" the spectrum of the up-sampled signal 922 to generate a resulting signal 924. Flipping the spectrum of the up-sampled signal 922 may change (e.g., "flip") the contents of the up-sampled signal 922 to opposite ends of the spectrum ranging from 0 Hz to 12.8 kHz. For example, content at 0 Hz of the up-sampled signal 922 may be at 12.8 kHz of the resulting signal 924, etc. Referring to FIG. 10, a particular illustrative non-limiting example of the resulting signal 924 is shown with respect to graph (c). The resulting signal 924 may be provided to the second sampler 906.

The second sampler 906 may be configured to up-sample the resulting signal 924 by five-fourths to generate the first synthesized high-band signal 842. Up-sampling the resulting signal 924 by five-fourths may increase the band of the resulting signal 924 to 0 Hz-16 kHz (e.g., 12.8 kHz*(5/4) =16 kHz) and may be performed by a quadrature mirror filter (QMF). Referring to FIG. 10, a particular illustrative non-limiting example of the first synthesized high-band signal 842 is shown with respect to graph (d). The first synthesized high-band signal 842 may be sampled at 32 kHz (e.g., the Nyquist sampling rate) and may correspond to a reconstructed version of the 6.4 kHz-12.8 kHz frequency band of the input audio signal.

The second path includes a third sampler 908 and a second spectrum flipping module 910. The second gain-adjusted baseband synthesized signal 834 may be provided to the third sampler 908. Referring to FIG. 10, a particular illustrative non-limiting example of the second gain-adjusted baseband synthesized signal 834 is shown with respect to graph (e). The second gain-adjusted baseband synthesized signal 834 may have a baseband bandwidth of 3.2 kHz, and the second gain-adjusted baseband synthesized signal 834 may be sampled at 6.4 kHz (e.g., the Nyquist sampling rate).

The third sampler 908 may be configured to up-sample the second gain-adjusted baseband synthesized signal 834 by five to generate an up-sampled signal 926. Up-sampling the second gain-adjusted baseband synthesized signal 834 by five may extend the band of the second gain-adjusted baseband synthesized signal 834 from 0 Hz-16 kHz (e.g., 3.2 kHz*5=16 kHz). Referring to FIG. 10, a particular illustrative non-limiting example of the up-sampled signal 926 is shown with respect to graph (f). The up-sampled signal 926 may be sampled at 32 kHz (e.g., the Nyquist sampling rate). The up-sampled signal 926 may be provided to the second spectrum flipping module 910.

The second spectrum flipping module 910 may be configured to "flip" the spectrum of the up-sampled signal 926 to generate the second synthesized high-band signal 844. Flipping the spectrum of the up-sampled signal 926 may change (e.g., "flip") the contents of the up-sampled signal 926 to opposite ends of the spectrum ranging from 0 Hz to 16 kHz. For example, content at 0 Hz of the up-sampled signal 922 may be at 16 kHz of the second synthesized high-band signal 844, content at 3.2 kHz of the up-sampled signal may be at 12.8 kHz of the second synthesized high-band signal 844, etc. Referring to FIG. 10, a particular illustrative non-limiting example of the second synthesized high-band signal 844 is shown with respect to graph (g). The second synthesized high-band signal 844 may be sampled at 32 kHz (e.g., the Nyquist sampling rate) and may correspond to a reconstructed version of the input audio signal ranging from 12.8 kHz-16 kHz.

It will be appreciated that the dual high-band signal generator 810 may reduce complex and computationally expensive operations associated with converting the gain-adjusted baseband synthesized signals 832, 834 into the synthesized high-band signals 842, 844. For example, the dual high-band signal generator 810 may reduce complex and computationally expensive operations associated with a down-mixer used in a single-band approach. Additionally, the synthesized high-band signals 842, 844 generated by the dual high-band signal generator 810 may represent a larger bandwidth of the input audio signal 102 (e.g., in the frequency range 6.4 kHz-16 kHz) than the bandwidth of a synthesized high-band signal generated using a single band (e.g., in the frequency range 6.4 kHz-14.4 kHz). A particular illustrative non-limiting example of a synthesized audio signal is shown with respect to graph (h) of FIG. 10.

Referring to FIG. 11, a flowchart of a particular aspect of a method 1100 for generating baseband signals is shown. The method 1100 may be performed by the system 100 of FIG. 1, the high-band excitation generator 160 of FIGS. 1-2B, the high-band generation circuitry 106 of FIGS. 1 and 5, or any combination thereof. For example, according to a first aspect, the method 1100 may be performed by the high-band excitation generator 160 to generate the high-band excitation signals 162, 164. According to a second aspect, the method 1100 may be performed by the high-band generation circuitry 106 to generate the baseband versions 126, 127 of the high-band signals 124, 125.

The method 1100 includes receiving, at a vocoder, an audio signal sampled at a first sample rate, at 1102. The method 1100 also includes generating a first baseband signal corresponding to a first sub-band of a high-band portion of the audio signal and a second baseband signal corresponding to a second sub-band of the high-band portion of the audio signal, at 1104.

According to the first aspect, the audio signal may be the input audio signal sampled at 32 kHz received at the analysis filter bank 110. The first baseband signal is a first high-band excitation signal, and the second baseband signal is a second high-band excitation signal. For example, referring to FIG. 1, the high-band excitation generator 160 may generate the first high-band excitation signal 162 (e.g., the first baseband signal) and the second high-band excitation signal 164 (e.g., the second baseband signal). The first high-band excitation signal 162 may have a baseband frequency range (e.g., between approximately 0 Hz and 6.4 kHz) that corresponds to the first high-band signal 124 (e.g., a first sub-band of a high-band portion of the input audio signal 102). For example, the high-band portion of the input audio signal 102 may correspond to components of the input audio signal occupying the frequency range between 6.4 kHz and 16 kHz. The baseband frequency of the first high-band excitation signal 162 may correspond to filtered components of the input audio signal 102 occupying the frequency range between 6.4 kHz and 12.8 kHz. The second high-band excitation signal 164 may have a baseband frequency range (e.g., between approximately 0 Hz and 3.2 kHz) that corresponds to the second high-band signal 125 (e.g., a second sub-band of the high-band portion of the input audio signal 102). For example, the baseband frequency of the second high-band excitation signal 164 may correspond to components of the input audio signal 102 occupying the frequency range between 12.8 kHz and 16 kHz.

According to the first aspect of the method 1100, generating the first baseband signal and the second baseband signal may include receiving, at a high-band encoder of the vocoder, a low-band excitation signal generated by a low-band encoder of the vocoder. For example, referring to FIG. 1, the high-band analysis module 150 may receive the low-band excitation signal 144 generated by the low-band analysis module 130. According to the first aspect of the method 1100, generating the first baseband signal may include up-sampling the low-band excitation signal according to a first up-sampling ratio to generate a first up-sampled signal. For example, referring to FIG. 2A, the third sampler 214 may up-sample the low-band excitation signal 144 by a ratio of two to generate the up-sampled signal 252. According to the first aspect of the method 1100, generating the second baseband signal may include up-sampling the low-band excitation signal according to a second up-sampling ratio to generate a second up-sampled signal. For example, referring to FIG. 2A, the first sampler 202 may up-sample the low-band excitation signal 144 by a ratio of two and a half to generate the up-sampled signal 232.

According to the first aspect, the method 1100 may include performing a nonlinear transformation operation on the first up-sampled signal to generate a first harmonically extended signal. For example, referring to FIG. 2A, the second nonlinear transformation generator 218 may perform a nonlinear transformation operation on the up-sampled signal 252 to generate the harmonically extended signal 254. According to the first aspect, the method 1100 may include performing a spectrum flip operation on the first harmonically extended signal to generate a first bandwidth-extended signal. For example, referring to FIG. 2A, the second spectrum flipping module 220 may perform a spectrum flip operation to generate the signal 256 (e.g., the first bandwidth-extended signal). The fourth sampler 222 may down-sample the first bandwidth-extended signal 256 to generate the first high-band excitation signal 162.

According to the first aspect, the method 1100 may include performing a nonlinear transformation operation on the second up-sampled signal to generate a second harmonically extended signal. For example, referring to FIG. 2A, the first nonlinear transformation generator 204 may perform a nonlinear transformation operation on the up-sampled signal 232 to generate the harmonically extended signal 234. According to the first aspect, the method 1100 may include performing a spectrum flip operation on the first harmonically extended signal to generate a first bandwidth-extended signal. For example, referring to FIG. 2A, the third spectrum flipping module 224 may perform a spectrum flip operation to generate the signal 258 (e.g., the second bandwidth-extended signal). The fifth sampler 226 may down-sample the second bandwidth-extended signal 256 to generate the second high-band excitation signal 164.

The method 1100 of FIG. 11, according to the first aspect, may reduce complex and computationally expensive operations associated with the pole-zero filter 206 and the down-mixer 210 according to the single-band mode of operation. Additionally, the method 1100 may generate high-band excitation signals 162, 164 that, collectively, represent a larger bandwidth of the input audio signal 102 (e.g., a frequency range of 6.4 kHz-16 kHz) than the bandwidth represented by the high-band excitation signal 242 (e.g., a frequency range of 6.4 kHz-14.4 kHz) generated according to the single-band mode.

According to the second aspect, the audio signal is the input audio signal 102, the first baseband signal is the baseband version 126 of the first high-band signal 124 of FIG. 1, and the second baseband signal is the baseband version 127 of the second high-band signal 125 of FIG. 1. The baseband version 126 of the first high-band signal 124 may have a baseband frequency range (e.g., between approximately 0 Hz and 6.4 kHz) that corresponds to the first high-band signal 124 (e.g., a first sub-band of a high-band portion of the input audio signal 102). For example, the high-band portion of the input audio signal 102 may correspond to components of the input audio signal occupying the frequency range between 6.4 kHz and 16 kHz. The baseband version 126 of the first high-band signal 124 may correspond to components of the input audio signal 102 occupying the frequency range between 6.4 kHz and 12.8 kHz. The baseband version 127 of the second high-band signal 125 may have a baseband frequency range (e.g., between approximately 0 Hz and 3.2 kHz) that corresponds to the second high-band signal 125 (e.g., a second sub-band of the high-band portion of the input audio signal 102). For example, the baseband version 127 of the second high-band signal 125 may correspond to components of the input audio signal 102 occupying the bandwidth between 12.8 kHz and 16 kHz.

According to the second aspect of the method 1100, generating the first baseband signal may include down-sampling the audio signal to generate a first down-sampled signal. For example, referring to FIG. 5, the second sampler 510 may down-sample the input audio signal 102 by five-fourths (e.g., up-sample the input audio signal 102 by fourth-fifths) to generate the down-sampled signal 542. A spectrum flip operation may be performed on the first down-sampled signal to generate a first resulting signal. For example, referring to FIG. 5, the second spectrum flipping module 512 may perform a spectrum flip operation on the down-sampled signal 542 to generate the resulting signal 544. The first resulting signal may be down-sampled to generate the first baseband signal. For example, referring to FIG. 5, the third sampler 516 may down-sample the resulting signal 544 by two (e.g., up-sample the resulting signal 544 by a factor of one-half) to generate the baseband version 126 of the first high-band signal 124 (e.g., the first baseband signal).

According to the second aspect of the method 1100, generating the second baseband signal may include performing a spectrum flip operation on the audio signal to generate a second resulting signal. For example, referring to FIG. 5, the third spectrum flipping module 518 may perform a spectrum flip operation on the input audio signal 102 to generate the resulting signal 546. The second resulting signal may be down-sampled to generate the second baseband signal. For example, referring to FIG. 5, the fourth sampler 520 may down-sample the resulting signal 546 by five (e.g., up-sample the resulting signal 546 by a factor of one-fifth) to generate the baseband version 127 of the second high-band signal 125 (e.g., the second baseband signal).

The method 1100 of FIG. 11, according to the second aspect, may reduce complex and computationally expensive operations associated with the pole-zero filter 502 and the down-mixer 506 according to the single-band mode of operation. Additionally, the method 1100 may generate baseband versions 126, 127 of the high-band signals 124, 125 that, collectively, represent a larger bandwidth of the input audio signal 102 (e.g., a frequency range of 6.4 kHz-16 kHz) than the bandwidth represented by the baseband version of the high-band signal 540 (e.g., a frequency range of 6.4 kHz-14.4 kHz) generated according to the single-band mode.

Referring to FIG. 12, a particular aspect of a method 1200 of using multiple-band nonlinear excitation for signal reconstruction is shown. The method 1200 may be performed by the system 800 of FIG. 8, the dual high-band signal generator 810 of FIGS. 8-10, or any combination thereof.

The method 1200 includes receiving, at a decoder, an encoded audio signal from an encoder, where the encoded audio signal comprises a low-band excitation signal, at 1202. For example, referring to FIG. 8, the high-band excitation generator 802 may receive the low-band excitation signal 144 as part of an encoded audio signal.

A first sub-band of a high-band portion of an audio signal may be reconstructed from the encoded audio signal based on the low-band excitation signal, at 1204. For example, referring to FIGS. 8-9, the dual high-band signal generator 810 may generate the first synthesized high-band signal 842 based on one or more synthesized signals (e.g., the first gain-adjusted baseband synthesized signal 832) derived from the low-band excitation signal 144.

A second sub-band of the high-band portion of the audio signal may be reconstructed from the encoded audio signal based on the low-band excitation signal, at 1206. For example, referring to FIGS. 8-9, the dual high-band signal generator 810 may generate the second synthesized high-band signal 844 based on one or more synthesized signals (e.g., the second gain-adjusted baseband synthesized signal 834) derived from the low-band excitation signal 144.

The method 1200 of FIG. 12 may reduce complex and computationally expensive operations associated with a down-mixer used in a single-band approach. Additionally, the synthesized high-band signals 842, 844 generated by the dual high-band signal generator 810 may represent a larger bandwidth of the input audio signal 102 (e.g., a frequency range of 6.4 kHz-16 kHz) than the bandwidth of a synthesized high-band signal generated using a single band.

Referring to FIG. 13, flowcharts of other particular aspect of methods 1300, 1320 for generating baseband signals are shown. The first method 1300 may be performed by the system 100 of FIG. 1, the high-band excitation generator 160 of FIGS. 1-2B, the high-band generation circuitry 106 of FIGS. 1 and 5, or any combination thereof. Similarly, the second method 1320 may be performed by the system 100 of FIG. 1, the high-band excitation generator 160 of FIGS. 1-2B, the high-band generation circuitry 106 of FIGS. 1 and 5, or any combination thereof.

The first method 1300 includes receiving, at a vocoder, an audio signal having a low-band portion and a high-band portion, at 1302. For example, referring to FIG. 1, the analysis filter band 110 may receive the input audio signal 102. The input audio signal 102 may be a SWB signal spanning from approximately 0 Hz to 16 kHz or a FB signal spanning from approximately 0 Hz to 20 kHz. The low-band portion of the SWB signal may span from 0 Hz to 6.4 kHz, and the high-band portion of the SWB signal may span from 6.4 kHz to 16 kHz. The low-band portion of the FB signal may span from 0 Hz to 8 kHz, and the high-band portion of the FB signal may span from 8 kHz to 20 kHz.

A low-band excitation signal may be generated based on the low-band portion of the audio signal, at 1304. For example, referring to FIG. 1, the low-band excitation signal 144 may be generated by the low-band analysis module 130 (e.g., a low-band encoder of a vocoder). For SWB encoding, the low-band excitation signal 144 may span from approximately 0 Hz to 6.4 kHz. For FB encoding, the low-band excitation signal 144 may span from approximately 0 Hz to 8 kHz.

A first baseband signal (e.g., a first high-band excitation signal) may be generated based on up-sampling the low-band excitation signal, at 1306. The first baseband signal may correspond to a first sub-band of the high-band portion of the audio signal. For example, referring to FIG. 2B, the first high-band excitation generator 280 may generate the first high-band excitation signal 162 by up-sampling the low-band excitation signal 144.

A second baseband signal (e.g., a second high-band excitation signal) may be generated based on the first baseband signal, at 1308. The second baseband signal may correspond to a second sub-band of the high-band portion of the audio signal. For example, referring to FIG. 2B, the second high-band excitation generator 282 may modulate white noise using the first high-band excitation signal 162 to generate the second high-band excitation signal 164.

The second method 1320 may include receiving, at a vocoder, an audio signal sampled at a first sample rate, at 1322. For example, referring to FIG. 1, the analysis filter band 110 may receive the input audio signal 102. The input audio signal 102 may be a SWB signal spanning from approximately 0 Hz to 16 kHz or a FB signal spanning from approximately 0 Hz to 20 kHz. The low-band portion of the SWB signal may span from 0 Hz to 6.4 kHz, and the high-band portion of the SWB signal may span from 6.4 kHz to 16 kHz. The low-band portion of the FB signal may span from 0 Hz to 8 kHz, and the high-band portion of the FB signal may span from 8 kHz to 20 kHz.

A low-band excitation signal may be generated at a low-band encoder of the vocoder based on a low-band portion of the audio signal, at 1324. For example, referring to FIG. 1, the low-band excitation signal 144 may be generated by the low-band analysis module 130 (e.g., a low-band encoder of a vocoder). For SWB encoding, the low-band excitation signal 144 may span from approximately 0 Hz to 6.4 kHz. For FB encoding, the low-band excitation signal 144 may span from approximately 0 Hz to 8 kHz.

A first baseband signal may be generated at a high-band encoder of the vocoder, at 1326. Generating the first baseband signal may include performing a spectral flip operation on a nonlinearly transformed version of the low-band excitation signal. For example, referring to FIG. 2A, the second spectrum flipping module 220 may perform a spectral flip operation on the second harmonically extended signal 254 (e.g., the nonlinearly transformed version of the low-band excitation signal according to the second method 1320). The nonlinearly transformed version of the low-band excitation signal 144 may be generated by up-sampling, at the third sampler 214, the low-band excitation signal 144 according to the first up-sampling ratio to generate the first up-sampled signal 252. The second nonlinear transformation generator 218 may perform a nonlinear transformation operation on the first up-sampled signal 252 to generate the nonlinearly transformed version of the low-band excitation signal. The fourth sampler 222 may down-sample a spectrally flipped version of the nonlinearly transformed version of the low-band excitation signal to generate the first baseband signal (e.g., the first high-band excitation signal 162).

A second baseband signal corresponding to a second sub-band of the high-band portion of the audio signal may be generated, at 1328. For example, referring to FIG. 2B, the second high-band excitation generator 282 may modulate white noise using the first high-band excitation signal 162 to generate the second baseband signal (e.g., the second high-band excitation signal 164).

The methods 1300, 1320 of FIG. 13, according to the second aspect, may reduce complex and computationally expensive operations associated with a pole-zero filter and a down-mixer according to the single-band mode of operation.

In particular aspects, the methods 1100, 1200, 1300, 1320 of FIGS. 11-13 may be implemented via hardware (e.g., an FPGA device, an ASIC, etc.) of a processing unit, such as a central processing unit (CPU), a DSP, or a controller, via a firmware device, or any combination thereof. As an example, the methods 1100, 1200, 1300, 1320 of FIGS. 11-13 can be performed by a processor that executes instructions, as described with respect to FIG. 14.

Referring to FIG. 14, a block diagram of a particular illustrative aspect of a device is depicted and generally designated 1400.

In a particular aspect, the device 1400 includes a processor 1406 (e.g., a CPU). The device 1400 may include one or more additional processors 1410 (e.g., one or more DSPs). The processors 1410 may include a speech and music CODEC 1408. The speech and music CODEC 1408 may include a vocoder encoder 1492, a vocoder decoder 1494, or both.

In a particular aspect, the vocoder encoder 1492 may a multiple-band encoding system 1482, and the vocoder decoder 1494 may include a multiple-band decoding system 1484. In a particular aspect, the multiple-band encoding system 1482 includes one or more components of the system 100 of FIG. 1, the high-band excitation generator 160 of FIGS. 1-2B, and/or the high-band generation circuitry 106 of FIGS. 1 and 5. For example, the multiple-band encoding system 1482 may perform encoding operations associated with the system 100 of FIG. 1, the high-band excitation generator 160 of FIGS. 1-2B, the high-band generation circuitry 106 of FIGS. 1 and 5, and the methods 1100, 1300, 1320 of FIGS. 11 and 13. In a particular aspect, the multiple-band decoding system 1484 may include one or more components of the system 800 of FIG. 8 and/or the dual high-band signal generator 810 of FIGS. 8-9. For example, the multiple-band decoding system 1484 may perform decoding operations associated with the system 800 of FIG. 8, the dual high-band signal generator 810 of FIGS. 8-9, and the method 1200 of FIG. 12. The multiple-band encoding system 1482 and/or the multiple-band decoding system 1484 may be implemented via dedicated hardware (e.g., circuitry), by a processor executing instructions to perform one or more tasks, or a combination thereof.

The device 1400 may include a memory 1432 and a wireless controller 1440 coupled to an antenna 1442. The device 1400 may include a display 1428 coupled to a display controller 1426. A speaker 1436, a microphone 1438, or both may be coupled to the CODEC 1434. The CODEC 1434 may include a digital-to-analog converter (DAC) 1402 and an analog-to-digital converter (ADC) 1404.

In a particular aspect, the CODEC 1434 may receive analog signals from the microphone 1438, convert the analog signals to digital signals using the analog-to-digital converter 1404, and provide the digital signals to the speech and music CODEC 1408, such as in a pulse code modulation (PCM) format. The speech and music CODEC 1408 may process the digital signals. In a particular aspect, the speech and music CODEC 1408 may provide digital signals to the CODEC 1434. The CODEC 1434 may convert the digital signals to analog signals using the digital-to-analog converter 1402 and may provide the analog signals to the speaker 1436.

The memory 1432 may include instructions 1460 executable by the processor 1406, the processors 1410, the CODEC 1434, another processing unit of the device 1400, or a combination thereof, to perform methods and processes disclosed herein, such as one or more of the methods of FIGS. 11-13. One or more components of the systems of FIGS. 1, 2A, 2B, 5, 8, and 9 may be implemented via dedicated hardware (e.g., circuitry), by a processor executing instructions (e.g., the instructions 1460) to perform one or more tasks, or a combination thereof. As an example, the memory 1432 or one or more components of the processor 1406, the processors 1410, and/or the CODEC 1434 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 1460) that, when executed by a computer (e.g., a processor in the CODEC 1434, the processor 1406, and/or the processors 1410), may cause the computer to perform at least a portion of one or more of the methods of FIGS. 11-13. As an example, the memory 1432 or the one or more components of the processor 1406, the processors 1410, and/or the CODEC 1434 may be a non-transitory computer-readable medium that includes instructions (e.g., the instructions 1460) that, when executed by a computer (e.g., a processor in the CODEC 1434, the processor 1406, and/or the processors 1410), cause the computer perform at least a portion of one or more of the methods FIGS. 11-13.

In a particular aspect, the device 1400 may be included in a system-in-package or system-on-chip device 1422, such as a mobile station modem (MSM). In a particular aspect, the processor 1406, the processors 1410, the display controller 1426, the memory 1432, the CODEC 1434, and the wireless controller 1440 are included in a system-in-package or the system-on-chip device 1422. In a particular aspect, an input device 1430, such as a touchscreen and/or keypad, and a power supply 1444 are coupled to the system-on-chip device 1422. Moreover, in a particular aspect, as illustrated in FIG. 14, the display 1428, the input device 1430, the speaker 1436, the microphone 1438, the antenna 1442, and the power supply 1444 are external to the system-on-chip device 1422. However, each of the display 1428, the input device 1430, the speaker 1448, the microphone 1446, the antenna 1442, and the power supply 1444 can be coupled to a component of the system-on-chip device 1422, such as an interface or a controller. In an illustrative example, the device 1400 corresponds to a mobile communication device, a smartphone, a cellular phone, a laptop computer, a computer, a tablet computer, a personal digital assistant, a display device, a television, a gaming console, a music player, a radio, a digital video player, an optical disc player, a tuner, a camera, a navigation device, a decoder system, an encoder system, or any combination thereof.

In conjunction with the described aspects, a first apparatus is disclosed that includes means for receiving an audio signal sampled at a first sample rate. For example, the means for receiving the audio signal may include the analysis filter bank 110 of FIG. 1, the high-band generation circuitry 106 of FIGS. 1 and 5, the processors 1410 of FIG. 14, one or more devices configured to receive the audio signal (e.g., a processor executing instructions at a non-transitory computer readable storage medium), or any combination thereof.

The first apparatus may also include means for generating a first baseband signal corresponding to a first sub-band of a high-band portion of the audio signal and a second baseband signal corresponding to a second sub-band of the high-band portion of the audio signal. For example, the means for generating the first baseband signal and the second baseband signal may include the high-band generation circuitry 106 of FIGS. 1 and 5, the high-band excitation generator 160 of FIGS. 1-2B, the processors 1410 of FIG. 14, one or more devices configured to generate the first baseband signal and the second baseband signal (e.g., a processor executing instructions at a non-transitory computer readable storage medium), or any combination thereof.

In conjunction with the described aspects, a second apparatus is disclosed that includes means for receiving an encoded audio signal from an encoder. The encoded audio signal comprises a low-band excitation signal. For example, the means for receiving the encoded audio signal may include the high-band excitation generator 802 of FIG. 8, the high-band synthesis filter 804 of FIG. 8, the first adjuster 806 of FIG. 8, the second adjuster 808 of FIG. 8, the processors 1410 of FIG. 14, one or more devices configured to receive the encoded audio signal (e.g., a processor executing instructions at a non-transitory computer readable storage medium), or any combination thereof.

The second apparatus may also include means for reconstructing a first sub-band of a high-band portion of an audio signal from the encoded audio signal based on the low-band excitation signal. For example, the means for reconstructing the first sub-band may include the high-band excitation generator 802 of FIG. 8, the high-band synthesis filter 804 of FIG. 8, the first adjuster 806 of FIG. 8, the dual high-band signal generator 810 of FIGS. 8-9, the processors 1410 of FIG. 14, one or more devices configured to reconstruct the first sub-band (e.g., a processor executing instructions at a non-transitory computer readable storage medium), or any combination thereof.

The second apparatus may also include means for reconstructing a second sub-band of the high-band portion of the audio signal from the encoded audio signal based on the low-band excitation signal. For example, the means for reconstructing the second sub-band may include the high-band excitation generator 802 of FIG. 8, the high-band synthesis filter 804 of FIG. 8, the second adjuster 808 of FIG. 8, the dual high-band signal generator 810 of FIGS. 8-9, the processors 1410 of FIG. 14, one or more devices configured to reconstruct the second sub-band (e.g., a processor executing instructions at a non-transitory computer readable storage medium), or any combination thereof.

In conjunction with the described aspects, a third apparatus is disclosed that includes means for receiving an audio signal having a low-band portion and a high-band portion. For example, the means for receiving the audio signal may include the analysis filter bank 110 of FIG. 1, the high-band generation circuitry 106 of FIGS. 1 and 5, the processors 1410 of FIG. 14, one or more devices configured to receive the audio signal (e.g., a processor executing instructions at a non-transitory computer readable storage medium), or any combination thereof.

The third apparatus may also include means for generating a low-band excitation signal based on the low-band portion of the audio signal. For example, the means for generating the low-band excitation signal may include the low-band analysis module 130 of FIG. 1, the processors 1410 of FIG. 14, one or more devices configured to generate the low-band excitation signal (e.g., a processor executing instructions at a non-transitory computer readable storage medium), or any combination thereof.

The third apparatus may further include means for generating a baseband signal (e.g., a first high-band excitation signal) based on up-sampling the low-band excitation signal. The first baseband signal may correspond to a first sub-band of the high-band portion of the audio signal. For example, the means for generating the baseband signal may include the high-band generation circuitry 106 of FIGS. 1 and 5, the high-band excitation generator 160 of FIGS. 1-2B, the third sampler 214 of FIG. 2A, the second nonlinear transformation generator 218 of FIG. 2A, the second spectrum flipping module 220 of FIG. 2A, the fourth sampler 222 of FIG. 2A, the first high-band excitation generator 280 of FIG. 2B, the processors 1410 of FIG. 14, one or more devices configured to generate the first baseband signal (e.g., a processor executing instructions at a non-transitory computer readable storage medium), or any combination thereof.

The third apparatus may also include means for generating a second baseband signal (e.g., a second high-band excitation signal) based on the first baseband signal. The second baseband signal may correspond to a second sub-band of the high-band portion of the audio signal. For example, the means for generating the second baseband signal may include the high-band generation circuitry 106 of FIGS. 1 and 5, the high-band excitation generator 160 of FIGS. 1-2B, the second high-band excitation generator 282 of FIG. 2B, the processors 1410 of FIG. 14, one or more devices configured to generate the second baseband signal (e.g., a processor executing instructions at a non-transitory computer readable storage medium), or any combination thereof.

In conjunction with the described aspects, a fourth apparatus is disclosed that includes means for receiving an audio signal sampled at a first sample rate. For example, the means for receiving the audio signal may include the analysis filter bank 110 of FIG. 1, the high-band generation circuitry 106 of FIGS. 1 and 5, the processors 1410 of FIG. 14, one or more devices configured to receive the audio signal (e.g., a processor executing instructions at a non-transitory computer readable storage medium), or any combination thereof.

The fourth apparatus may also include means for generating a low-band excitation signal based on a low-band portion of the audio signal. For example, the means for generating the low-band excitation signal may include the low-band analysis module 130 of FIG. 1, the processors 1410 of FIG. 14, one or more devices configured to generate the low-band excitation signal (e.g., a processor executing instructions at a non-transitory computer readable storage medium), or any combination thereof.

The fourth apparatus may also include means for generating a first baseband signal. Generating the first baseband signal may include performing a spectral flip operation on a nonlinearly transformed version of the low-band excitation signal. The first baseband signal may correspond to a first sub-band of a high-band portion of the audio signal. For example, the means for generating the first baseband signal may include the third sampler 214 of FIG. 2A, the nonlinear transformation generator 218 of FIG. 2A, the second spectrum flipping module 220 of FIG. 2A, the fourth sampler 222 of FIG. 2A, the first high-band excitation generator 280 of FIG. 2B, the high-band excitation generator 160 of FIGS. 1-2B, the processors 1410 of FIG. 14, one or more devices configured to perform the spectral flip operation (e.g., a processor executing instructions at a non-transitory computer readable storage medium), or any combination thereof.

The fourth apparatus may also include means for generating a second baseband signal corresponding to a second sub-band of the high-band portion of the audio signal. The first sub-band may be distinct from the second sub-band. For example, the means for generating the second baseband signal may include the high-band generation circuitry 106 of FIGS. 1 and 5, the high-band excitation generator 160 of FIGS. 1-2B, the second high-band excitation generator 282 of FIG. 2B, the processors 1410 of FIG. 14, one or more devices configured to generate the second baseband signal (e.g., a processor executing instructions at a non-transitory computer readable storage medium), or any combination thereof.

Those of skill would further appreciate that the various illustrative logical blocks, configurations, modules, circuits, and algorithm steps described in connection with the aspects disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A method comprising:

receiving, at a vocoder, an audio signal sampled at a first sample rate;

generating, at a low-band encoder of the vocoder, a low-band excitation signal based on a low-band portion of the audio signal;

generating a first baseband signal at a high-band encoder of the vocoder, wherein generating the first baseband signal includes performing a spectral flip operation on a nonlinearly transformed version of the low-band excitation signal, the first baseband signal corresponding to a first sub-band of a high-band portion of the audio signal;

generating a second baseband signal corresponding to a second sub-band of the high-band portion of the audio signal, wherein the first sub-band is distinct from the second sub-band; and outputting high-band side information to a decoder, the high-band side information based at least in part on the first baseband signal and the second baseband signal.

2. The method of claim 1, wherein the second baseband signal is generated based on the first baseband signal, and wherein generating the second baseband signal comprises modulating white noise using the first baseband signal.

3. The method of claim 1, wherein generating the nonlinearly transformed version of the low-band excitation signal comprises:

up-sampling, at the high-band encoder of the vocoder, the low-band excitation signal according to a first up-sampling ratio to generate a first up-sampled signal; and performing a nonlinear transformation operation on the first up-sampled signal to generate the nonlinearly transformed version of the low-band excitation signal.

4. The method of claim 3, further comprising down-sampling a spectrally flipped version of the nonlinearly transformed version of the low-band excitation signal to generate the first baseband signal.

5. The method of claim 1, wherein the high-band portion of the audio signal corresponds to a frequency band spanning from approximately 6.4 kilohertz (kHz) to approximately 16 kHz according to a super wideband coding scheme.

6. The method of claim 5, wherein the first sub-band spans from approximately 6.4 kHz to approximately 12.8 kHz, and wherein the second sub-band spans from approximately 12.8 kHz to approximately 16 kHz.

7. The method of claim 1, wherein the high-band portion of the audio signal corresponds to a frequency band spanning from approximately 8 kilohertz (kHz) to approximately 20 kHz according to a full band coding scheme.

8. The method of claim 7, wherein the first sub-band spans from approximately 8 kHz to approximately 16 kHz, and wherein the second sub-band spans from approximately 16 kHz to approximately 20 kHz.

9. The method of claim 1, wherein the first baseband signal corresponds to a first high-band excitation signal, and wherein the second baseband signal corresponds to a second high-band excitation signal.

10. The method of claim 9, wherein a bandwidth of the first high-band excitation signal is from approximately 0 hertz (Hz) to approximately 6.4 kilohertz (kHz), and wherein a bandwidth of the second high-band excitation signal is from approximately 0 Hz to approximately 3.2 kHz.

11. The method of claim 9, wherein a bandwidth of the first high-band excitation signal is from approximately 0 hertz (Hz) to approximately 8 kilohertz (kHz), and wherein a bandwidth of the second high-band excitation signal is from approximately 0 Hz to approximately 4 kHz.

12. The method of claim 1, wherein generating the first baseband signal and generating the second baseband signal are performed within a device that comprises a mobile communication device.

13. The method of claim 1, wherein generating the first baseband signal and generating the second baseband signal are performed within a device that comprises a base station.

14. An apparatus comprising:

a low-band encoder of a vocoder configured to:

receive an audio signal sampled at a first sample rate; and generate a low-band excitation signal based on a low-band portion of the audio signal;

a high-band encoder of the vocoder configured to:

generate a first baseband signal, wherein generating the first baseband signal includes performing a spectral flip operation on a nonlinearly transformed version of the low-band excitation signal, the first baseband signal corresponding to a first sub-band of a high-band portion of the audio signal;

generate a second baseband signal corresponding to a second sub-band of the high-band portion of the audio signal, wherein the first sub-band is distinct from the second sub-band;

output high-band side information to a decoder, the high-band side information based at least in part on the first baseband signal and the second baseband signal.

15. The apparatus of claim 14, wherein the second baseband signal is generated based on the first baseband signal, and wherein generating the second baseband signal comprises modulating white noise using the first baseband signal.

16. The apparatus of claim 14, wherein the high-band encoder is further configured to:

up-sample the low-band excitation signal according to a first up-sampling ratio to generate a first up-sampled signal; and perform a nonlinear transformation operation on the first up-sampled signal to generate the nonlinearly transformed version of the low-band excitation signal.

17. The apparatus of claim 16, wherein the high-band encoder is further configured to down-sample a spectrally flipped version of the nonlinearly transformed version of the low-band excitation signal to generate the first baseband signal.

18. The apparatus of claim 14, wherein the high-band portion of the audio signal corresponds to a frequency band spanning from approximately 6.4 kilohertz (kHz) to approximately 16 kHz according to a super wideband coding scheme.

19. The apparatus of claim 18, wherein the first sub-band spans from approximately 6.4 kHz to approximately 12.8 kHz, and wherein the second sub-band spans from approximately 12.8 kHz to approximately 16 kHz.

20. The apparatus of claim 14, wherein the high-band portion of the audio signal corresponds to a frequency band spanning from approximately 8 kilohertz (kHz) to approximately 20 kHz according to a full band coding scheme.

21. The apparatus of claim 20, wherein the first sub-band spans from approximately 8 kHz to approximately 16 kHz, and wherein the second sub-band spans from approximately 16 kHz to approximately 20 kHz.

22. The apparatus of claim 14, wherein the first baseband signal corresponds to a first high-band excitation signal, and wherein the second baseband signal corresponds to a second high-band excitation signal.

23. The apparatus of claim 22, wherein a bandwidth of the first high-band excitation signal is from approximately 0 hertz (Hz) to approximately 6.4 kilohertz (kHz), and wherein a bandwidth of the second high-band excitation signal is from approximately 0 Hz to approximately 3.2 kHz.

24. The apparatus of claim 22, wherein a bandwidth of the first high-band excitation signal is from approximately 0 hertz (Hz) to approximately 8 kilohertz (kHz), and wherein a bandwidth of the second high-band excitation signal is from approximately 0 Hz to approximately 4 kHz.

25. The apparatus of claim 14, further comprising:

an antenna; and a transmitter coupled to the antenna and configured to transmit an encoded audio signal.

26. The apparatus of claim 25, wherein the transmitter, the low-band encoder, and the high-band encoder are integrated into a mobile communication device.

27. The apparatus of claim 25, wherein the transmitter, the low-band encoder, and the high-band encoder are integrated into a base station.

28. A non-transitory computer-readable medium comprising instructions that, when executed by a processor within a vocoder, cause the processor to perform operations comprising:

receiving an audio signal sampled at a first sample rate;

generating, at a low-band encoder of the vocoder, a low-band excitation signal based on a low-band portion of the audio signal;

generating a first baseband signal at a high-band encoder of the vocoder, wherein generating the first baseband signal includes performing a spectral flip operation on a nonlinearly transformed version of the low-band excitation signal, the first baseband signal corresponding to a first sub-band of a high-band portion of the audio signal;

generating a second baseband signal corresponding to a second sub-band of the high-band portion of the audio signal, wherein the first sub-band is distinct from the second sub-band; and outputting high-band side information to a decoder, the high-band side information based at least in part on the first baseband signal and the second baseband signal.

29. The non-transitory computer-readable medium of claim 28, wherein the second baseband signal is generated based on the first baseband signal, and wherein generating the second baseband signal comprises modulating white noise using the first baseband signal.

30. The non-transitory computer-readable medium of claim 28, wherein the operations further comprise:

up-sampling, at the high-band encoder of the vocoder, the low-band excitation signal according to a first up-sampling ratio to generate a first up-sampled signal; and performing a nonlinear transformation operation on the first up-sampled signal to generate the nonlinearly transformed version of the low-band excitation signal.

31. The non-transitory computer-readable medium of claim 30, wherein the operations further comprise down-sampling a spectrally flipped version of the nonlinearly transformed version of the low-band excitation signal to generate the first baseband signal.

32. The non-transitory computer-readable medium of claim 28, wherein the high-band portion of the audio signal corresponds to a frequency band spanning from approximately 8 kilohertz (kHz) to approximately 20 kHz according to a full band coding scheme.

33. The non-transitory computer-readable medium of claim 32, wherein the first sub-band spans from approximately 8 kHz to approximately 16 kHz, and wherein the second sub-band spans from approximately 16 kHz to approximately 20 kHz.

34. The non-transitory computer-readable medium of claim 28, wherein the first baseband signal corresponds to a first high-band excitation signal, and wherein the second baseband signal corresponds to a second high-band excitation signal.

35. The non-transitory computer-readable medium of claim 34, wherein a bandwidth of the first high-band excitation signal is from approximately 0 hertz (Hz) to approximately 6.4 kilohertz (kHz), and wherein a bandwidth of the second high-band excitation signal is from approximately 0 Hz to approximately 3.2 kHz.

36. The non-transitory computer-readable medium of claim 34, wherein a bandwidth of the first high-band excitation signal is from approximately 0 hertz (Hz) to approximately 8 kilohertz (kHz), and wherein a bandwidth of the second high-band excitation signal is from approximately 0 Hz to approximately 4 kHz.

37. An apparatus comprising:

means for receiving an audio signal sampled at a first sample rate; and means for generating a low-band excitation signal based on a low-band portion of the audio signal;

means for generating a first baseband signal, wherein generating the first baseband signal includes performing a spectral flip operation on a nonlinearly transformed version of the low-band excitation signal, the first baseband signal corresponding to a first sub-band of a high-band portion of the audio signal;

means for generating a second baseband signal corresponding to a second sub-band of the high-band portion of the audio signal, wherein the first sub-band is distinct from the second sub-band; and means for outputting high-band side information to a decoder, the high-band side information based at least in part on the first baseband signal and the second baseband signal.

38. The apparatus of claim 37, wherein the high-band portion of the audio signal corresponds to a frequency band spanning from approximately 8 kilohertz (kHz) to approximately 20 kHz according to a full band coding scheme.

39. The apparatus of claim 38, wherein the first sub-band spans from approximately 8 kHz to approximately 16 kHz, and wherein the second sub-band spans from approximately 16 kHz to approximately 20 kHz.

40. The apparatus of claim 37, wherein the first baseband signal corresponds to a first high-band excitation signal, and wherein the second baseband signal corresponds to a second high-band excitation signal.

41. The apparatus of claim 40, wherein a bandwidth of the first high-band excitation signal is from approximately 0 hertz (Hz) to approximately 6.4 kilohertz (kHz), and wherein a bandwidth of the second high-band excitation signal is from approximately 0 Hz to approximately 3.2 kHz.

42. The apparatus of claim 40, wherein a bandwidth of the first high-band excitation signal is from approximately 0 hertz (Hz) to approximately 8 kilohertz (kHz), and wherein a bandwidth of the second high-band excitation signal is from approximately 0 Hz to approximately 4 kHz.

43. The apparatus of claim 37, wherein the means for receiving the audio signal, the means for generating the low-band excitation signal, the means for generating the first baseband signal, and the means for generating the second baseband signal are integrated into a mobile communication device.

44. The apparatus of claim 37, wherein the means for receiving the audio signal, the means for generating the low-band excitation signal, the means for generating the first baseband signal, and the means for generating the second baseband signal are integrated into a base station.

* * * * *